US010981761B2

(12) United States Patent
Manzi

(10) Patent No.: US 10,981,761 B2
(45) Date of Patent: Apr. 20, 2021

(54) APPARATUS FOR LIFTING AND TRANSPORTING LOADS, IN PARTICULAR CONTAINERS

(71) Applicant: CVS FERRARI S.P.A., Cadeo (IT)

(72) Inventor: Cristiano Manzi, Genoa (IT)

(73) Assignee: CVS FERRARI S.P.A., Cadeo (IT)

( * ) Notice: Subject to any disclaimer, the term of this patent is extended or adjusted under 35 U.S.C. 154(b) by 531 days.

(21) Appl. No.: 15/747,707

(22) PCT Filed: Jul. 27, 2016

(86) PCT No.: PCT/IB2016/054479
§ 371 (c)(1),
(2) Date: Jan. 25, 2018

(87) PCT Pub. No.: WO2017/017620
PCT Pub. Date: Feb. 2, 2017

(65) Prior Publication Data

US 2018/0222732 A1 Aug. 9, 2018

(30) Foreign Application Priority Data

Jul. 28, 2015 (IT) ..... 102015000039054

(51) Int. Cl.
*B66F 9/07* (2006.01)
*B66F 9/075* (2006.01)
(Continued)

(52) U.S. Cl.
CPC ..... *B66F 9/07* (2013.01); *B66F 9/07513* (2013.01); *B66F 9/07559* (2013.01);
(Continued)

(58) Field of Classification Search
CPC ..... B66F 9/24; B66F 9/08; B66F 9/20; B66F 9/18; B66F 9/07572
See application file for complete search history.

(56) References Cited

U.S. PATENT DOCUMENTS 2,918,143 A 12/1959 Shaffer
3,970,205 A 7/1976 Del Puppo
(Continued)

FOREIGN PATENT DOCUMENTS

DE 2528809 A1 1/1976
DE 3435690 A1 4/1986
(Continued)

OTHER PUBLICATIONS

International Search Report dated Apr. 5, 2012 for related PCT Application No. PCT/IB2011/054633.
(Continued)

*Primary Examiner* — Diem M Tran
(74) *Attorney, Agent, or Firm* — Shuttleworth & Ingersoll, PLC; Timothy J. Klima

(57) ABSTRACT

An apparatus for lifting and transporting loads, in particular corresponding containers, preferably in the form of empty containers, including a support chassis, for resting and movement means of the apparatus with respect to the ground, in particular including means, or front wheels, for resting and movement and means, or rear wheels, for resting and movement, in particular said front and/or rear means, or wheels, for resting and movement having a respective transversal, or horizontal, rotation axis; lifting and lowering means of the load, including a respective mast, in particular extending upwards, and gripping means of the load, which gripping means are mobile along said mast; said mast of said lifting and lowering means of the load being positioned at or posteriorly of the respective rotation axis of the front means, or wheels, for resting and movement of the apparatus with respect to the ground.

20 Claims, 22 Drawing Sheets

(51) Int. Cl.
*B66F 9/18* (2006.01)
*B66F 9/08* (2006.01)
*B66F 9/24* (2006.01)

(52) U.S. Cl.
CPC ..... *B66F 9/07572* (2013.01); *B66F 9/08* (2013.01); *B66F 9/18* (2013.01); *B66F 9/186* (2013.01); *B66F 9/24* (2013.01); *Y10S 903/903* (2013.01)

(56) References Cited

U.S. PATENT DOCUMENTS

| | | | | |
|---|---|---|---|---|
| 4,015,686 | A | 4/1977 | Bushnell, Jr. | |
| 5,391,043 | A | 2/1995 | Bohata et al. | |
| 5,641,261 | A | 6/1997 | Talbert et al. | |
| 6,398,480 | B1 | 6/2002 | Baginski et al. | |
| 2004/0124020 | A1 | 7/2004 | Leifert | |
| 2006/0043914 | A1 | 3/2006 | Langlotz | |
| 2011/0313608 | A1 | 12/2011 | Izumi et al. | |
| 2016/0221808 | A1* | 8/2016 | Babel ..... | B62D 33/06 |

FOREIGN PATENT DOCUMENTS

| | | | |
|---|---|---|---|
| DE | 102008012406 | A1 | 9/2009 |
| EP | 2080732 | A1 | 7/2009 |
| EP | 2151413 | A1 | 2/2010 |
| FR | 2911861 | A1 | 8/2008 |
| GB | 2290281 | A | 12/1995 |
| WO | WO03086944 | A1 | 10/2003 |
| WO | WO2004069568 | A1 | 8/2004 |
| WO | WO2010114036 | A1 | 10/2010 |
| WO | WO2012146956 | A1 | 11/2012 |

OTHER PUBLICATIONS

Office Action issued by the European Patent Office dated Jan. 22, 2015 for related European Patent Application No. 11801837.3.

Office Action issued by the European Patent Office dated Jul. 13, 2018 for related European Patent Application No. 16182807.4.

International Search Report and Written Opinion dated Nov. 29, 2016 from counterpart PCT App No. PCT/IB2016/054479.

European Office Action dated May 29, 2019 from counterpart European App No. 16766364.0.

Rosalind Takata, Reports on How Things Work, 2.972 How Hybrid Electric Vehicles Work, Feb. 2014, https://web.archive.org/web/20140223195753/https://web.mit.edu/2.972/www/reports/hybrid_vehicle/hybrid_electric_vehicles.html.

* cited by examiner

APPARATUS FOR LIFTING AND TRANSPORTING LOADS, IN PARTICULAR CONTAINERS

This application is the National Phase of International Application PCT/IB2016/054479 filed Jul. 27, 2016 which designated the U.S. and that International Application was published under PCT Article 21(2) in English.

This application claims priority to Italian Patent Application No. 102015000039054 filed Jul. 28, 2015, which application is incorporated by reference herein.

TECHNICAL FIELD

The present invention relates to an apparatus for lifting and transporting loads, in particular containers, preferably in the form of empty containers. Said containers are for intermodal transport, and preferably are ISO containers.

BACKGROUND ART

Apparatuses are known for lifting and transporting containers, preferably in the form of empty containers; comprising a support chassis, resting and movement means of the apparatus with respect to the ground, in particular comprising front means, or wheels, for resting and movement and rear means, or wheels for resting and movement, said front and/or rear means, or wheels for resting and movement in particular having a respective transversal, or horizontal, rotation axis of the lifting and lowering means of the load comprising a respective mast, in particular extending upwards, and gripping means of the load, which gripping means are mobile along said mast.

The above-mentioned known-type apparatuses for lifting containers present on the market are activated exclusively by respective internal combustion engines, preferably high-powered and heavy diesel engines which also require a significant use of fuel.

Further, said known-type apparatuses for lifting containers have a significant weight, in particular determined by the ballast counterweights, which leads to working costs in terms of fuel consumption and wear on the tyres of the wheels, which are particularly high and disadvantageous for user companies and especially require excessive refuelling and maintenance breaks.

Also known are lifting apparatuses that are powered entirely by electricity, prevalently utilised internally of closed environments, such as warehouses or the like, and which use only electric batteries for powering the lifting motor means, in which the potential energy of the lifting mast and the load, if present, is recycled during the descent steps but which however do not enable efficient energy recycling as the batteries are not able to rapidly store all the energy of the mast and necessitate, in order to avoid damage, dissipating a part of this recyclable energy.

Also known are hybrid lifting apparatuses utilising internal combustion drive units, which are combined with electrical drive units and which enable a certain recuperation of the braking energy of the apparatus but not the lifting energy and which are moreover not used in the sector of movement of containers.

Therefore a need is perceived in the sector for having available an apparatus for lifting and transporting loads, in particular of corresponding containers, which has modest working costs, in particular a minimum use of fuel.

In the sector, however, a need is perceived for having available an apparatus for lifting and transporting loads, in particular of corresponding containers, which is easy and not expensive to construct.

A need is perceived in the sector for having available an apparatus for lifting and transporting loads, in particular of corresponding containers, which is easy and not expensive to maintain.

A need is also perceived in the sector for having available an apparatus for lifting and transporting loads, in particular of corresponding containers, which is easy to use for the driver.

In the sector, however, a need is perceived for having available an apparatus for lifting and transporting loads, in particular of corresponding containers, which is easily transportable and assemblable in the place of use.

SUMMARY OF THE INVENTION

The present invention therefore proposes a new solution as an alternative to the solutions known up to now and, in particular, proposes to obviate one or more of the above mentioned drawbacks or problems and/or to meet one or more of the needs felt in the trade or inferable from the above.

An apparatus for lifting and transporting loads, in particular containers, is therefore provided, especially for intermodal transport, such as ISO containers, preferably in the guise of empty containers; comprising a support chassis, for resting and movement means of the apparatus with respect to the ground, in particular comprising means, or front wheels, for resting and movement and means, or rear wheels, for resting and movement, in particular said front and/or rear means, or wheels, for resting and movement having a respective transversal, or horizontal, rotation axis; lifting and lowering means of the load, comprising a respective mast, in particular extending upwards, preferably in the form of a telescopic mast, and gripping means of the load, which gripping means are mobile along said mast; characterised in that the mast of said lifting and lowering means of the load has a respective centre of gravity positioned at, or posteriorly of, the respective rotation axis of the front means, or wheels, for resting and movement of the apparatus, i.e. with respect to the pivot point of the apparatus which is defined by the resting point on the ground of the front means, or wheels for resting and movement, in particular said centre of gravity of the mast being longitudinally distanced from said axis or from the pivot point in a measure comprised between 0 mm and 1000 mm, and preferably comprised between 50 mm and 500 mm.

In this way, the use of the counterweight can be limited, and an apparatus is realised that uses less energy and has more modest working costs.

BRIEF DESCRIPTION OF THE DRAWINGS

These and other innovative aspects of the invention, or specific advantageous features, are set out in the appended claims and its technical features and advantages are apparent from the detailed description which follows of a preferred, advantageous embodiment of it, which must be considered purely as a non-limiting example, said description being made with reference to the accompanying drawings, in which:

DETAILED DESCRIPTION OF PREFERRED EMBODIMENTS OF THE INVENTION

Figure 1:
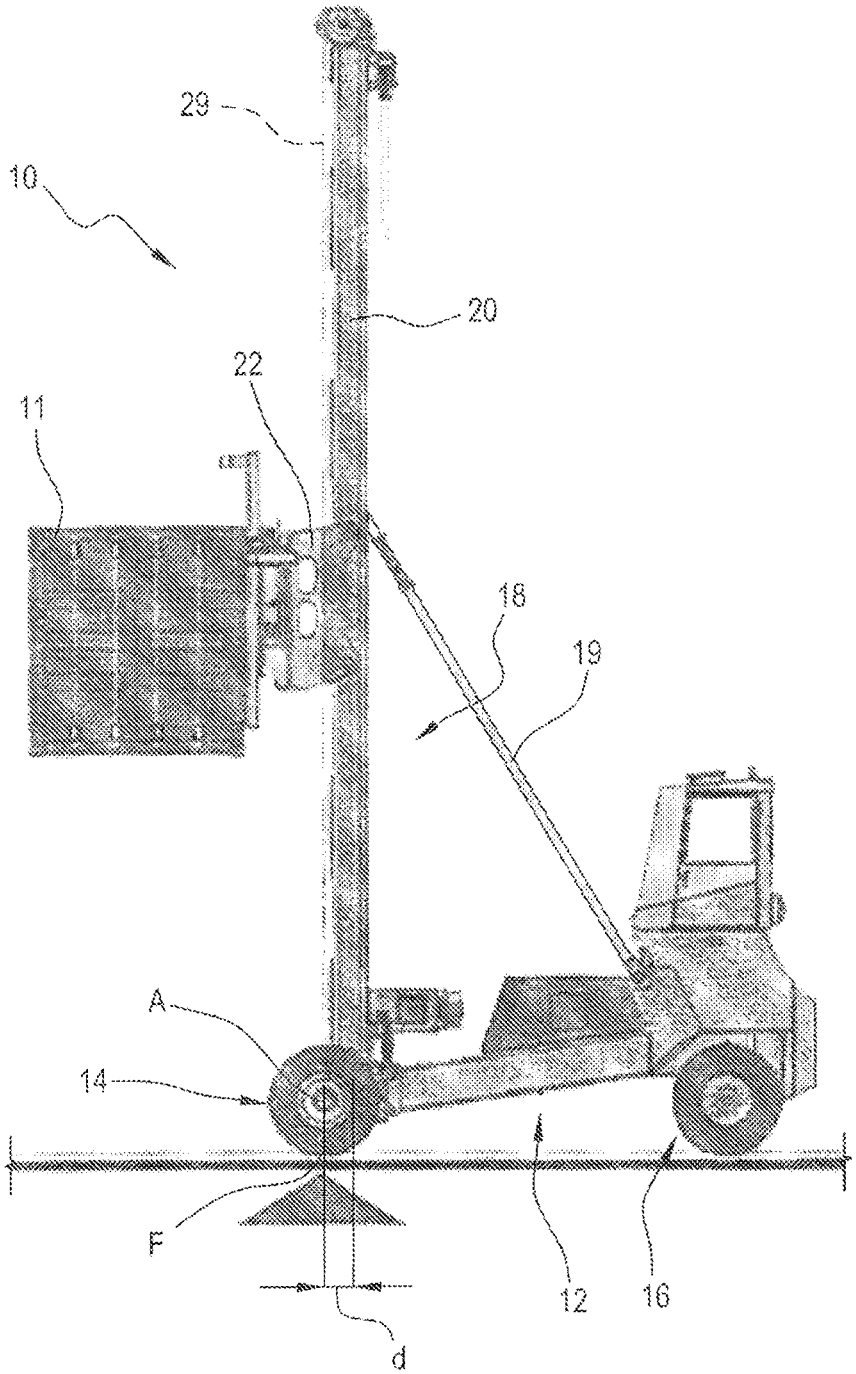
FIG. 1 is a lateral view of a preferred embodiment of the apparatus according to the present invention.

The accompanying figures illustrate a preferred embodiment 10 of an apparatus for lifting and transporting loads, in particular for lifting and transporting containers 11 which, in particular, as can clearly be observed in FIG. 1, are for intermodal transport, in particular ISO containers, and preferably in the form of empty containers.

In particular, the apparatus comprises a support chassis 12, in particular extending prevalently according to a respective longitudinal direction, and resting and movement means of the apparatus with respect to the ground, in particular comprising front means 14, or wheels, for resting and movement and rear means, or wheels 16 for resting and movement.

In this way, said front and/or rear means, or wheels 14, 16, for resting and movement, have a respective transversal, or horizontal, rotation axis.

In particular, said rear wheels 16 define the steering wheels of the apparatus.

The apparatus further comprises lifting and lowering means 18 of the load, comprising a respective mast 20 extending in an upwards direction, preferably in the form of a telescopic mast having a base element 20' that is fixed to the chassis of the apparatus and one or more telescopic members 20" that are vertically mobile with respect to said fixed mast and, possibly, reciprocally mobile with respect to one another.

The lifting means 18 further comprise securing or gripping means 22 of the load or container 11, as clearly visible in FIG. 1, said gripping means of the load 11 being mobile along said mast 20, perpendicularly to the support chassis 12 and/or to the ground.

As illustrated, the mast 20 of said lifting and lowering means of the load advantageously has a respective centre of gravity which, at least when the mast is vertical or perpendicular to the ground, is positioned posteriorly of the rotation axis A of the front means, or wheels 14 for resting and movement of the apparatus, i.e. with respect to the pivot point F of the apparatus which is defined by the resting point on the ground of the front means 14, or wheels for resting and movement, and which is perpendicular to said rotation axis A of said front means, or wheels 14.

Further the mast 20 of said lifting and lowering means of the load can advantageously have a respective centre of gravity which, at least when the mast is vertical or perpendicular to the ground, is positioned at, i.e. vertically aligned to, the respective rotation axis A of the front resting means, or wheels 14, for resting and movement of the apparatus, i.e. with respect to the pivot point F of the apparatus which is defined by the resting point on the ground of the front means 14, or wheels, for resting and movement, and which is perpendicular to said rotation axis A of said front means, or wheels 14.

In this way, an advantageous balancing effect of the weight of the mast is obtained with respect to the tipping point of the apparatus, which enables avoiding the use of large weights or counterweights.

In particular, said centre of gravity of the mast is advantageously longitudinally distanced from said axis A or from the pivot point F in a measure "d" comprised between 0 mm and 1000 mm, and preferably comprised between 50 mm and 500 mm.

In this way, an advantageous balancing effect of the weight of the mast 20 and an advantageous and effective gripping action are obtained of the respective load or container 11.

As can be observed in FIGS. 2A to 3C, said support chassis 12 of the apparatus comprises a front frame 121 supported on the front means, or wheels 14, for resting and movement and a rear frame 122 supported on the rear means, or wheels 16 for resting and movement, which front frame 121 and rear frame 122 are connected to one another by the connecting means 123, in particular in the form of disengageable connecting means.

In this way, a structure is obtained which, in the demounted condition, is smaller and easier to transport.

As can be observed also with reference to following FIGS. 4A to 4D, said support chassis 12 comprises a first and a second longitudinal member 15, 15 frontally projecting, in particular with respect to the mast 20, for rotatable support for the respective front means, or wheels, for resting and movement 14, 14.

In particular, as illustrated, said first and second longitudinal members 15, 15, for supporting the respective front means, or wheels, for resting and movement 14, 14 extend parallel to one another.

As illustrated, said first and second longitudinal members 15, 15, for rotatable support of the respective front means, or wheels, for resting and movement 14, 14 advantageously extend from said front frame 121.

As illustrated, said front frame 121 advantageously comprises a respective transversal element or cross-member 17, in particular in the form of a respective supporting beam element.

As illustrated, said first and second longitudinal rotatable support members 15, 15 projecting frontally are advantageously prolonged from said transversal element 17 of said front frame 121, especially from the opposite lateral ends of the transversal element 17.

Said front frame 121 advantageously has, in plan view from above, a generally U-shaped conformation, in particular defined by said transversal element 17 and by said short longitudinal members 15, 15 for rotatable support, projecting from the transversal element 17.

As illustrated, said transversal beam element 17 advantageously has a main support body, in particular tubular, which in particular extends more greatly vertically or perpendicularly, and preferably has a rectangular tubular profile, the respective long side being directed vertically or perpendicularly.

The respective longitudinal element is advantageously in the form of a plate element 15, in particular orientated vertically, having a respective opening 15' for inserting the respective axle, in particular a motor-driven axle, as will emerge more fully in the following part of the present description, of the respective means, or wheel, for resting and movement 14, 14, and/or attaching means projecting towards the outside for respective front means, or wheel, for resting and movement 14, 14'.

Said transversal beam element 17 advantageously has respective reinforcing gussets, respectively upper and/or lower, 157, 157, which project frontally from said transversal beam element 17, and which connect rigidly to the respective longitudinal plate 15 defining the corresponding rotatable support element of the respective front means, or wheels. As illustrated, said gussets are prolonged proceeding from the respective plate defining the connecting means to the rear frame and/or to the mast 20.

As illustrated, the respective longitudinal element 15 has a respective reinforcing flange 151, centrally open, which is supported externally to the plate 15, which, as can be observed, is welded to the end of the beam element 17.

Figure 3A:
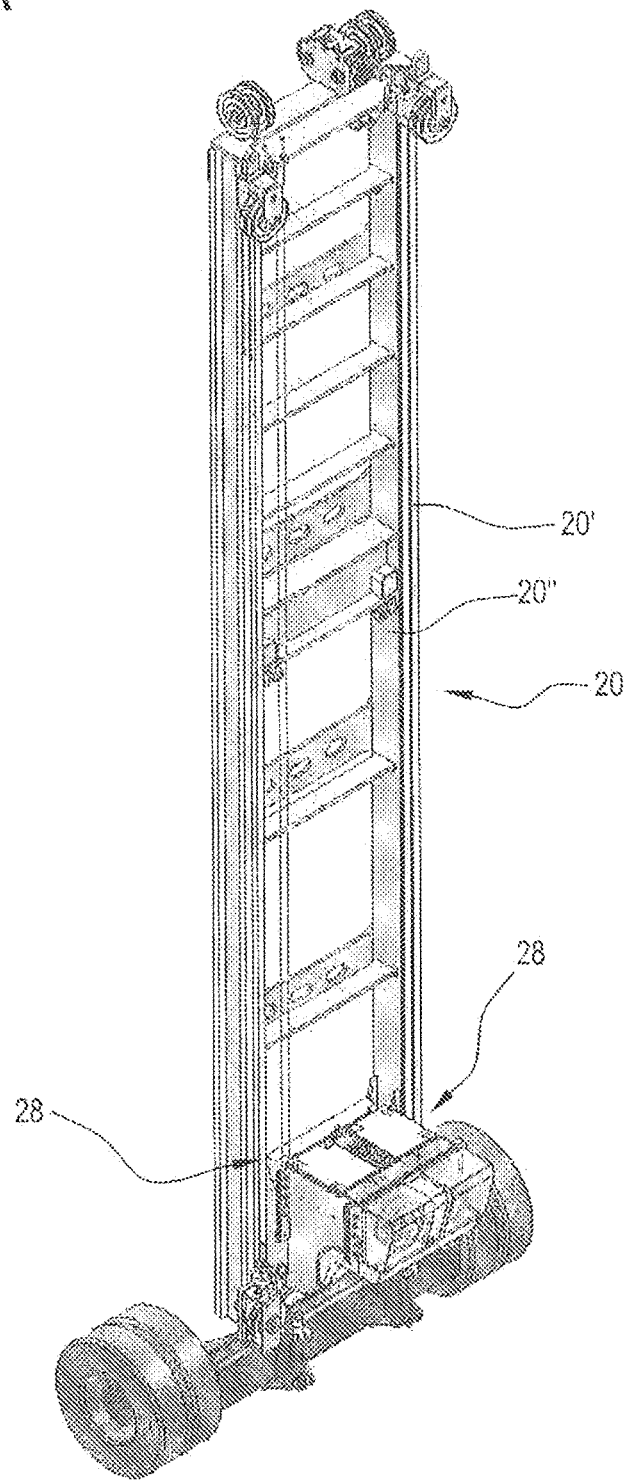
FIG. 3A is a perspective view of the front frame and mast of the preferred embodiment of the apparatus according to the present invention.
Figure 3B:
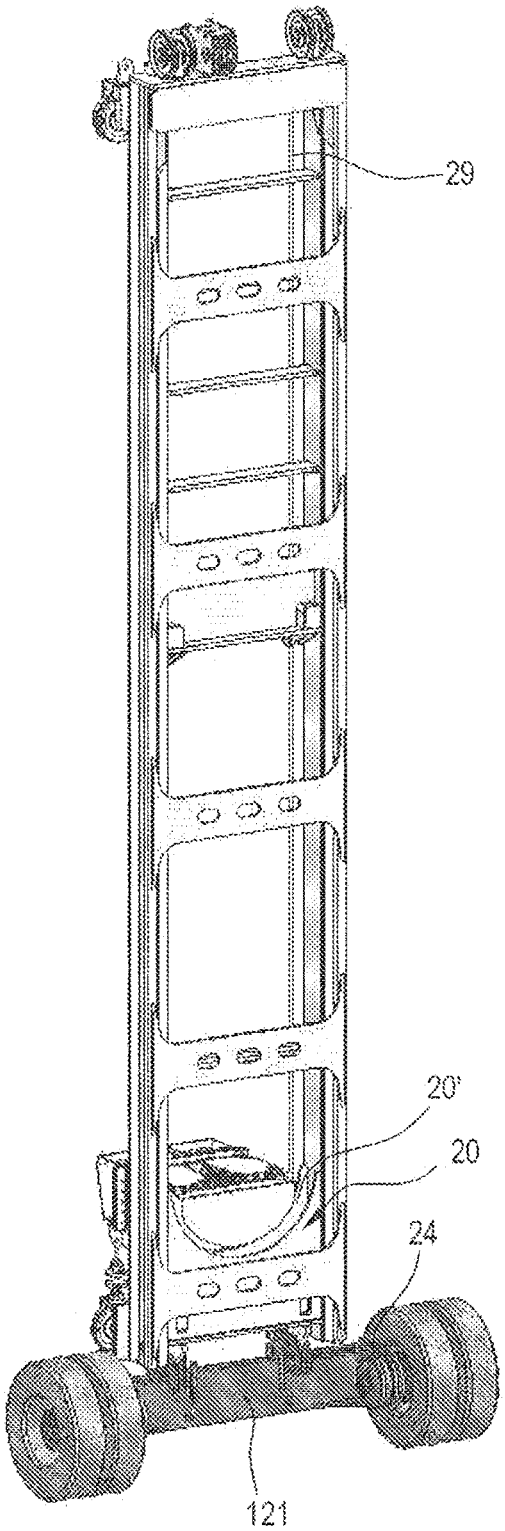
FIG. 3B is a perspective view of the front frame and mast, seen from the opposite side in relation to FIG. 3A, of the preferred embodiment of the apparatus according to the present invention.
Figure 3C:
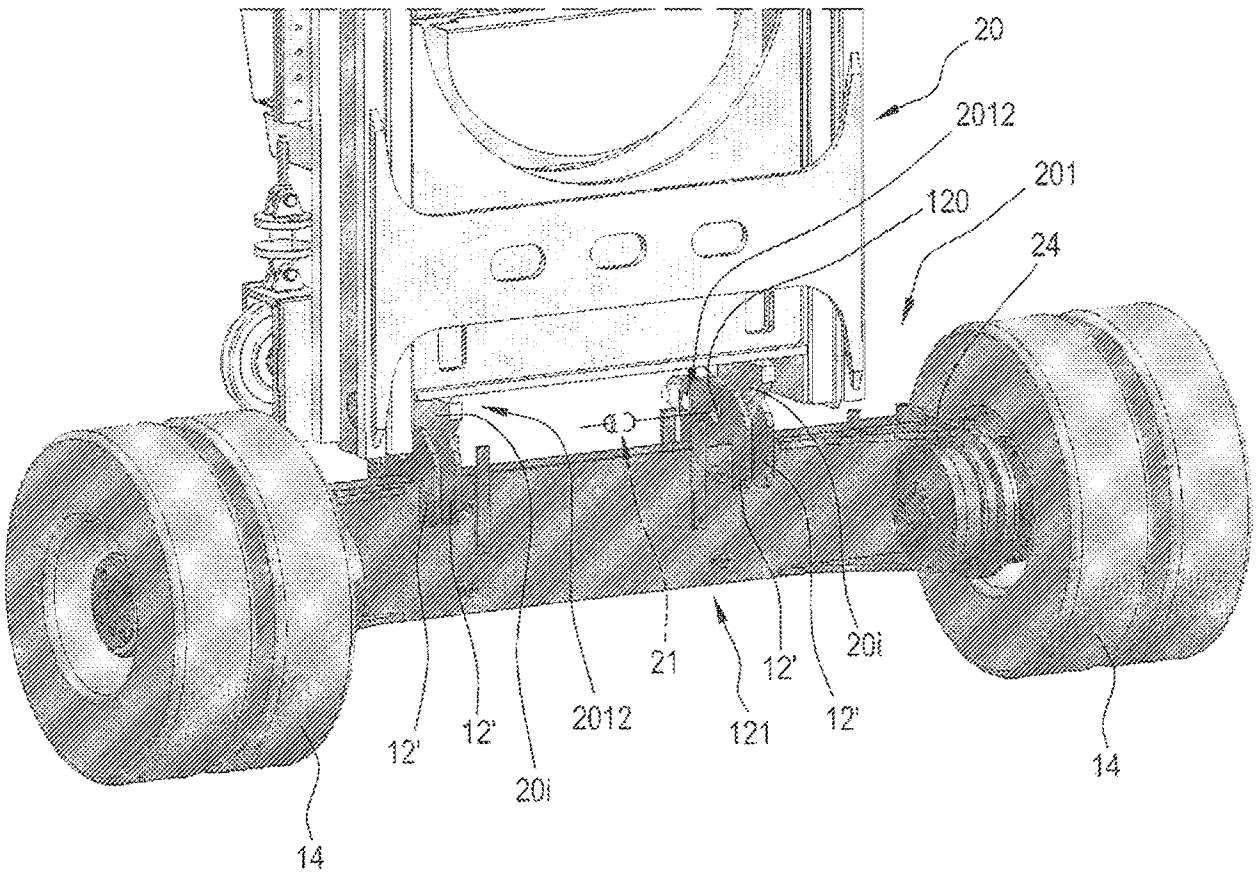
FIG. 3C is a perspective view of a detail of the attachment part of the front frame and mast of the preferred embodiment of the apparatus according to the present invention.

As illustrated, in particular in FIGS. 3A to 3C, said mast 20 of the lifting and lowering means of the load is advantageously supported by said front frame 121, in particular by the transversal element 17 of the front frame 121.

In particular, said mast 20 of the lifting and lowering means of the load 11 is advantageously hingedly connected, i.e. pivoted, to said front frame 121 of the support chassis 12, in particular to the transversal element 17 of the front frame 121, in particular having said mast 20, i.e. the lower fixed element 20' thereof, i.e. the respective lower end 201, hingedly connected, in particular pivoted, at 2012, to said front frame 121.

In particular, as can be seen from FIG. 1, said mast 20 of the lifting and lowering means of the load 11 is connected to said rear frame 122 via corresponding actuator means or hydraulic cylinders 19, 19, preferably, though not illustrated in detail, being connected at an upper end of the mast 20, i.e. of the fixed base element 20' of said mast. When activated these means command the tilting or rotation of the mast 20 with respect to the pivoted point of connection.

The present apparatus advantageously, comprises means 21, 120 for attaching the mast 20, in particular the fixed base element 20' thereof to the support chassis 12.

Said means for attaching advantageously comprise pivot means 21 which insert in corresponding hole means at the lower end of the mast 20 and in hole means 120 at said support chassis 12, in particular at said front frame 121, in particular at said transversal element and/or beam element 17 of said front frame 121.

The apparatus 10 advantageously comprises rotation means, or tilting means, of the mast 20 with respect to the support chassis 12 of the apparatus. In particular, the rotation means, or tilting means, of the mast 20 with respect to the support chassis 12 of the apparatus are defined by said pivot means 21 for attaching the mast to the support chassis of the apparatus.

Said means for attaching 21, 120 are advantageously arranged superiorly of said support chassis 12, in particular superiorly of said front frame 121, in particular superiorly of said transversal element and/or beam element 17 of said front frame 121, preferably vertically, or perpendicularly, aligned thereto.

As illustrated, said front frame 121 advantageously has corresponding plate means 12', in particular extending vertically, preferably in the form of a first and a second pair of plates 12', 12' transversally spaced from one another in order to receive a respective lower end 20*i* of the respective mast 20.

Said first and second pair of plates 12'. 12' are transversally spaced from one another and received the lower end of the mast 20 between them.

Said plate means 12' project superiorly of the front frame 121, in particular of the transversal element and/or beam element 17 thereof, and define respective hole means 120 for said pivot means 21 for attachment of the mast, having respective hole means for receiving the respective pivot 21.

Said connecting means 123 between the front frame 121 and the rear frame 122 advantageously comprise first 123' and second 123" connecting means, respectively upper and lower, in particular being provided respectively above and below the beam element 17 at the lower end of the beam element 17.

Said connecting means 120 between the front frame 121 and the rear frame 122 are advantageously provided posteriorly to the beam element 17, in particular comprising first 123' and second 123" connecting means provided posteriorly of said beam element 17, in particular posteriorly of the posterior face thereof.

Said connecting means 120 between the front frame 121 and the rear frame 122 advantageously comprise respective pivot means 123'*p*, 123"*p* which insert in corresponding hole means 123'*f*, 123"*f* provided respectively in the first frame 121 and in corresponding hole means provided in the second frame 122, in particular at said upper connecting means and said lower connecting means.

In particular, the connecting means 123 between the front frame 121 and the rear frame 122 advantageously extend transversally with respect to the longitudinal direction of the apparatus, or the prevalent prolongation of the chassis of the apparatus, the pivot means 123'*p*, 123"*p* being especially in the form of pivot means which are insertable in, and deinsertable from, respective hole means 123'*a*, 123'*a* preferably by means of a respective pushing movement, or traction movement, which is directed parallel to the axis of the respectively hole.

In this way it is possible to carry out rapid and easy reciprocal mounting and demounting of the front frame 121 and rear frame 122 of the chassis of the apparatus, all preferably in the interest of simplicity in carrying out the transport operations of the apparatus.

Figure 2A:
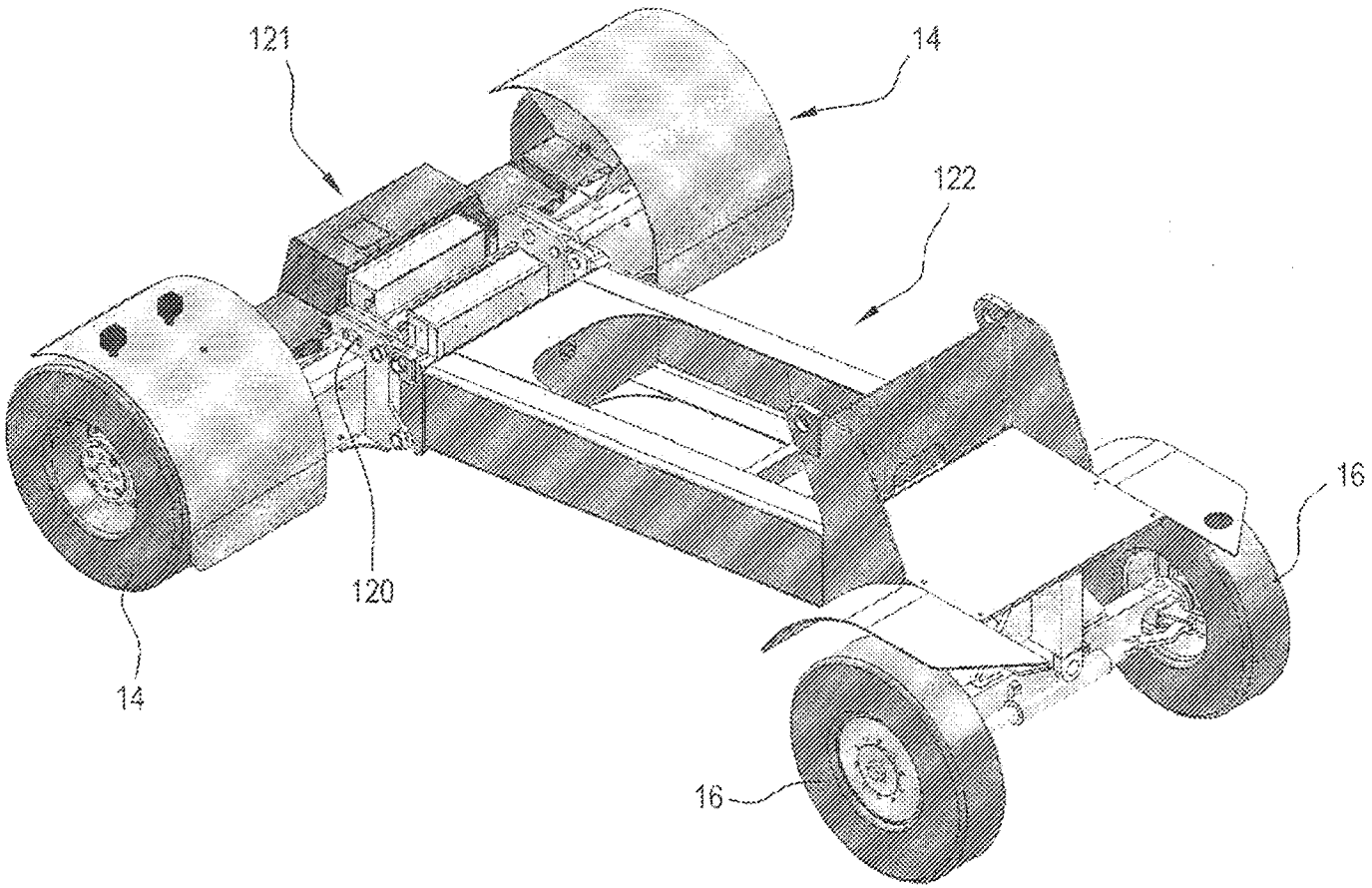
FIG. 2A is a perspective view of the support chassis of the preferred embodiment of the apparatus according to the present invention.
Figure 2B:
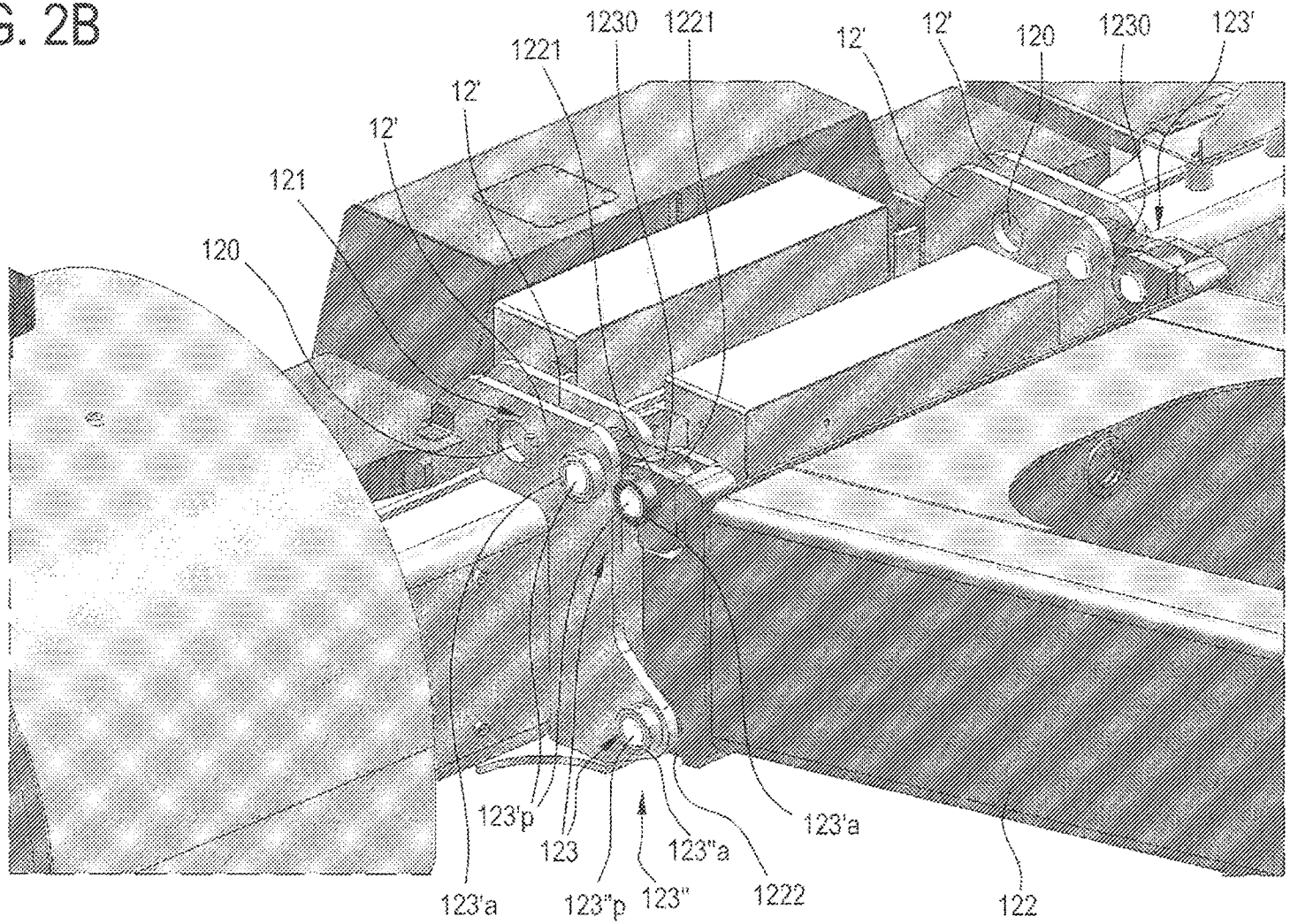
FIG. 2B is a perspective view of a detail of the front part of the support chassis of the preferred embodiment of the apparatus according to the present invention.
Figure 4A:
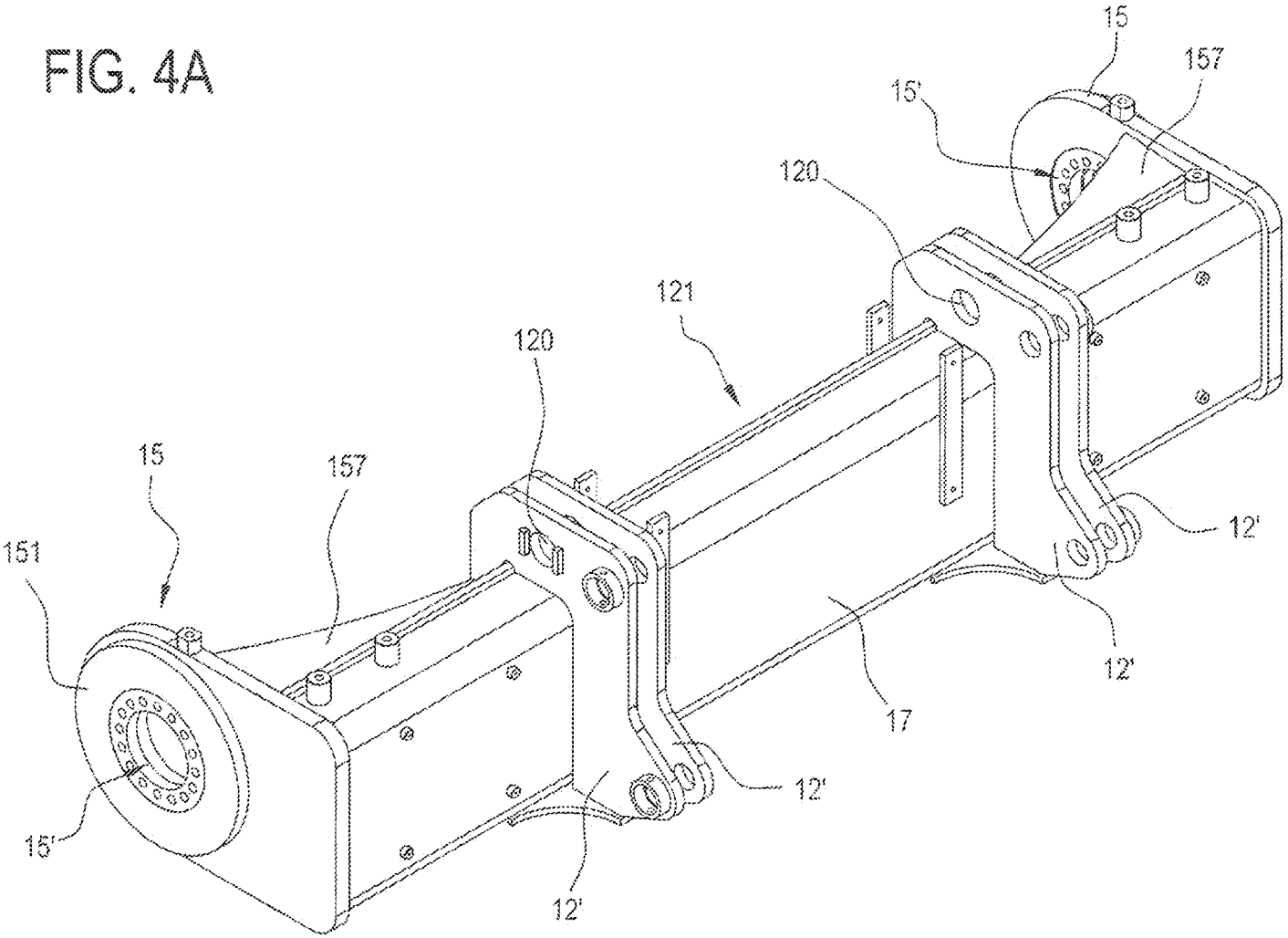
FIG. 4A is a perspective view of only the front frame of the preferred embodiment of the apparatus according to the present invention.
Figure 4B:
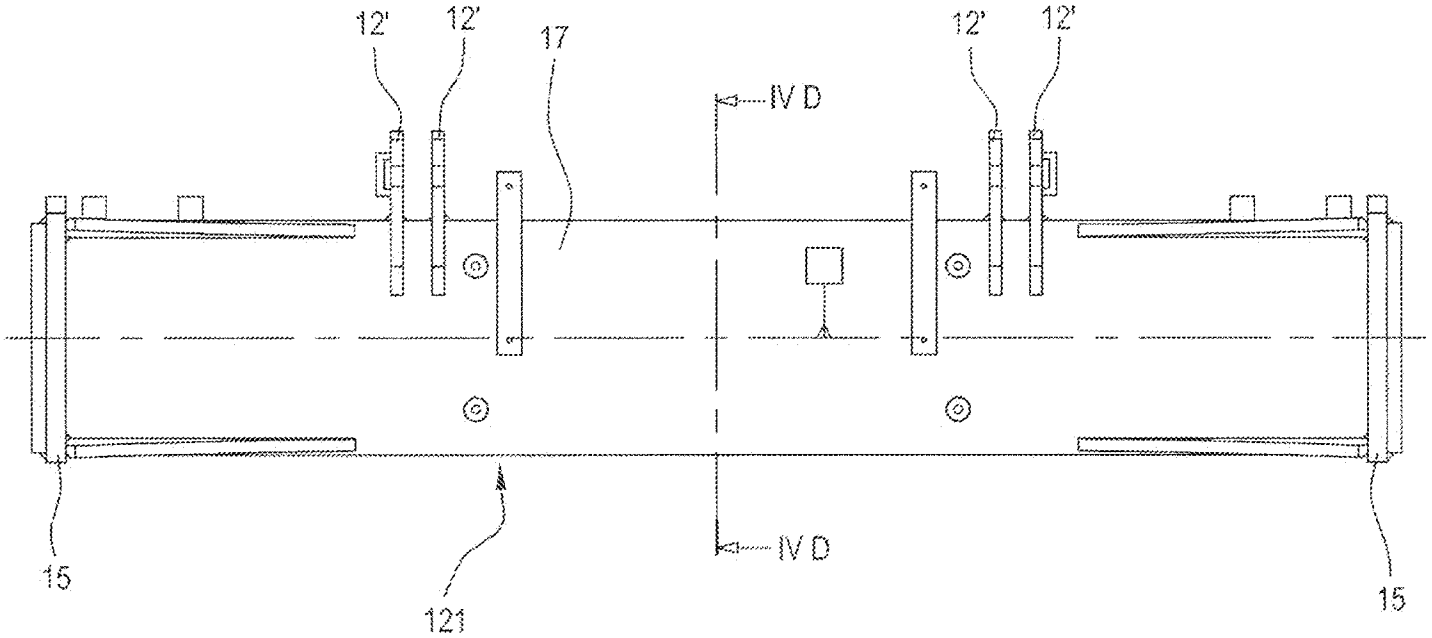
FIG. 4B is a frontal view of the front frame of the preferred embodiment of the apparatus according to the present invention.
Figure 4C:
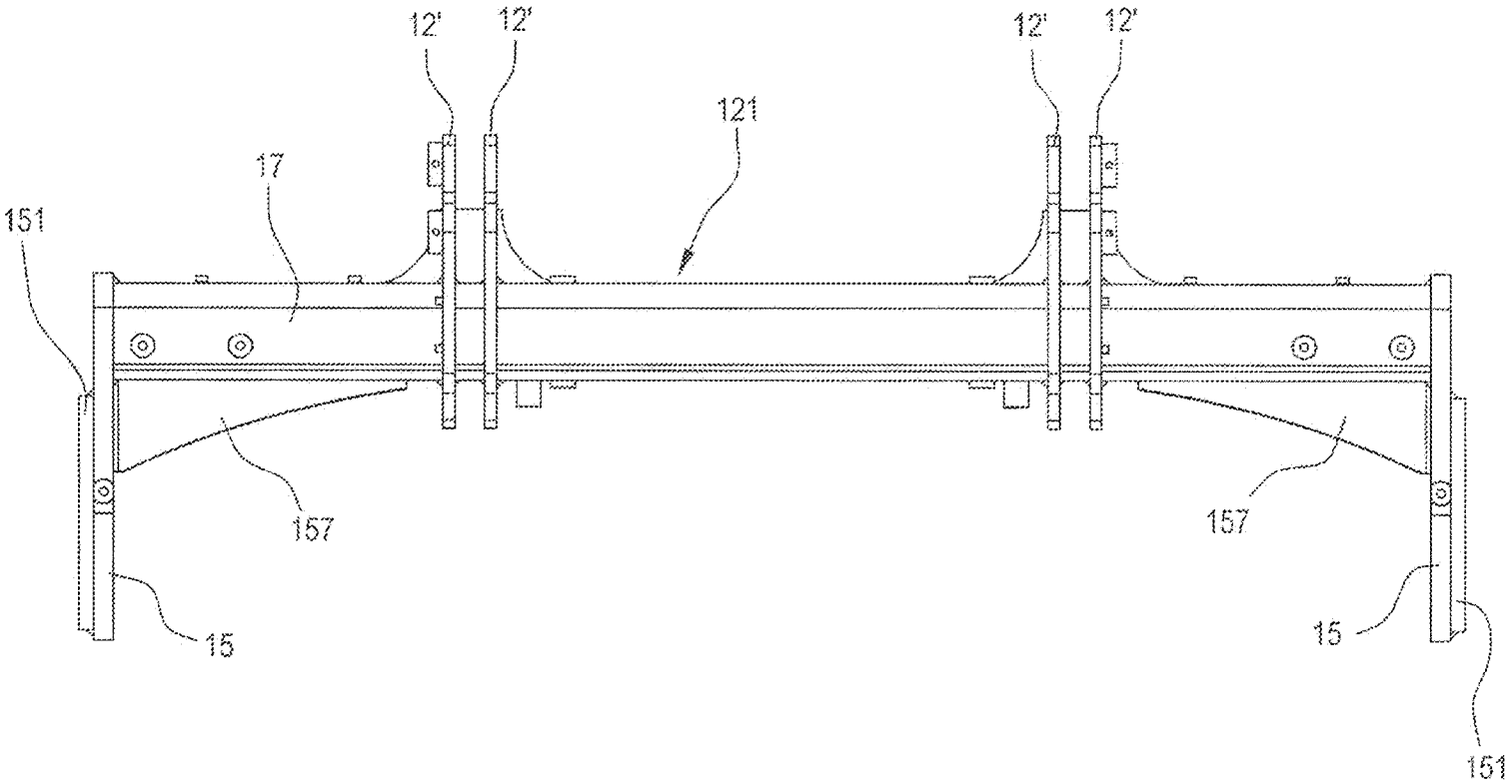
FIG. 4C is a plan view from above of the front frame of the preferred embodiment of the apparatus according to the present invention.
Figure 4D:
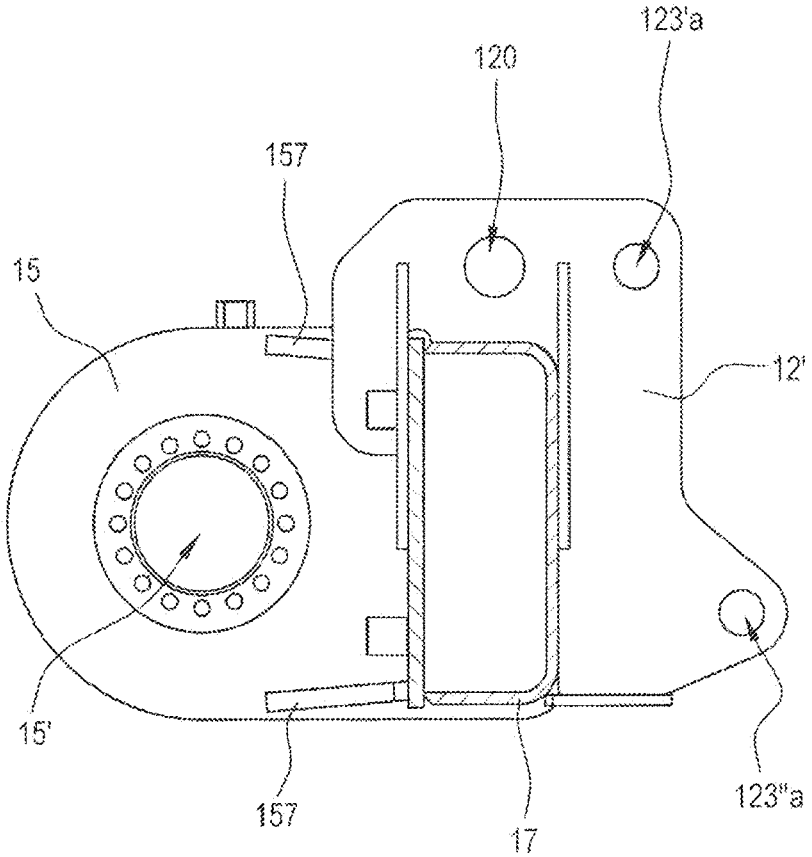
FIG. 4D is a view in longitudinal section of the front frame of the preferred embodiment of the apparatus according to the present invention.
Figure 4E:
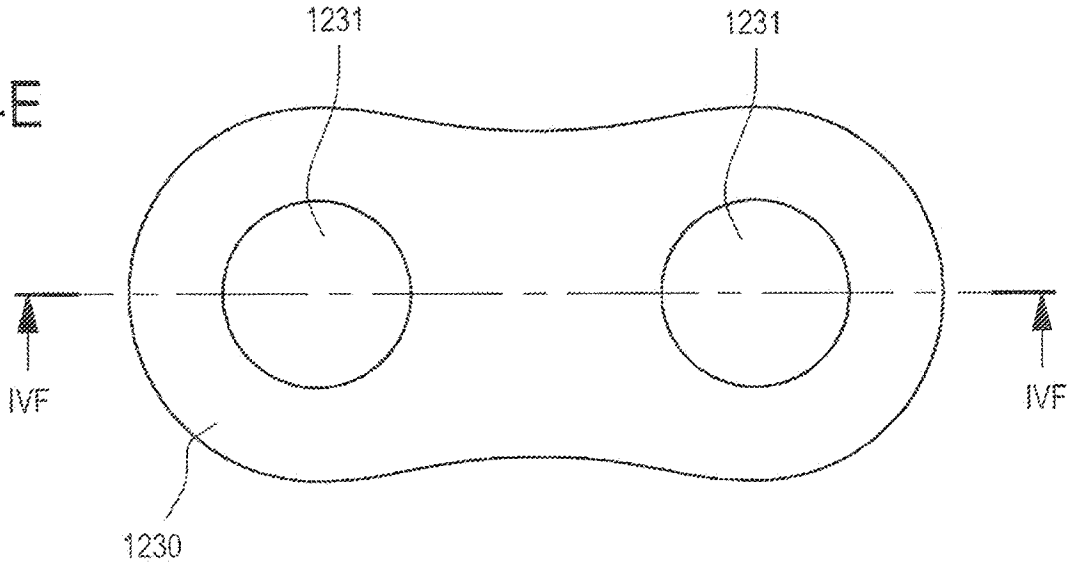
FIG. 4E is a lateral view of the connecting rod of the front frame to the rear frame of the preferred embodiment of the apparatus according to the present invention.
Figure 4F:
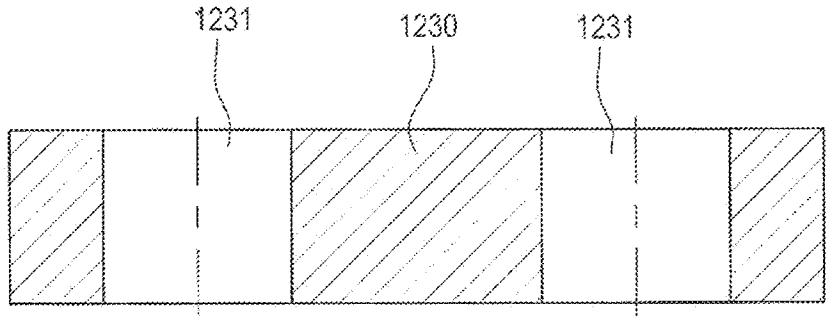
FIG. 4F is a horizontal section view, taken along line IVF of FIG. 4E, of the connecting rod of the front frame to the rear frame of the preferred embodiment of the apparatus according to the present invention.
Figure 5A:
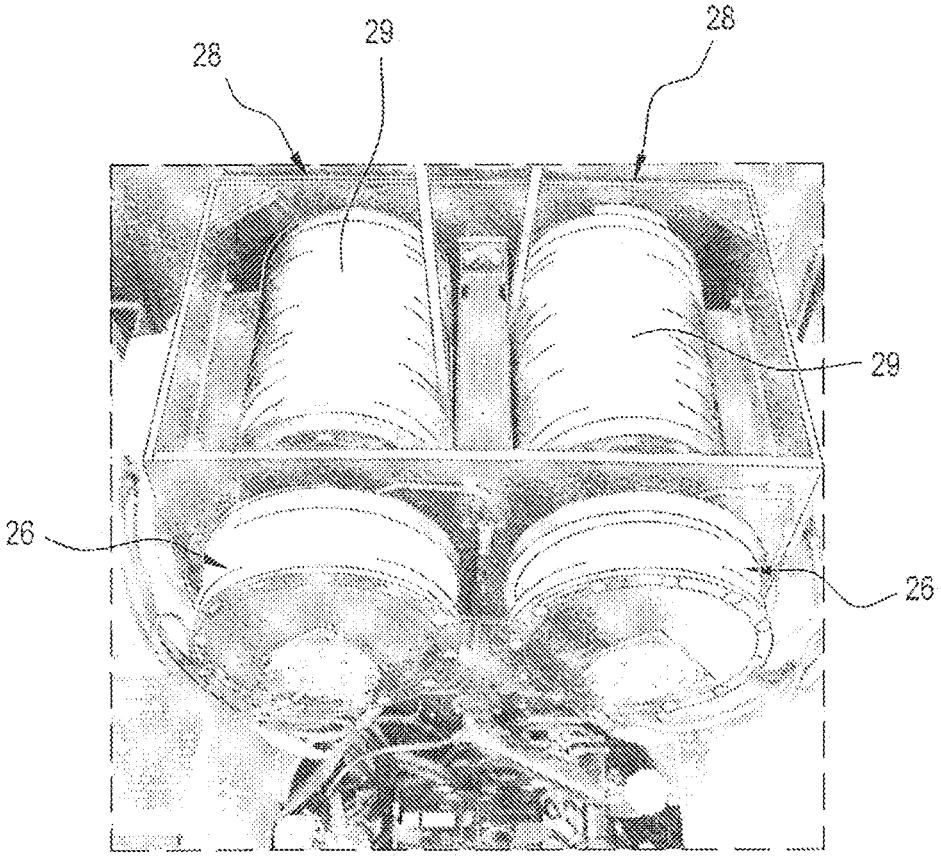
FIG. 5A is a perspective view of the winches and the respective lifting motors of the preferred embodiment of the apparatus according to the present invention.
Figure 5B:
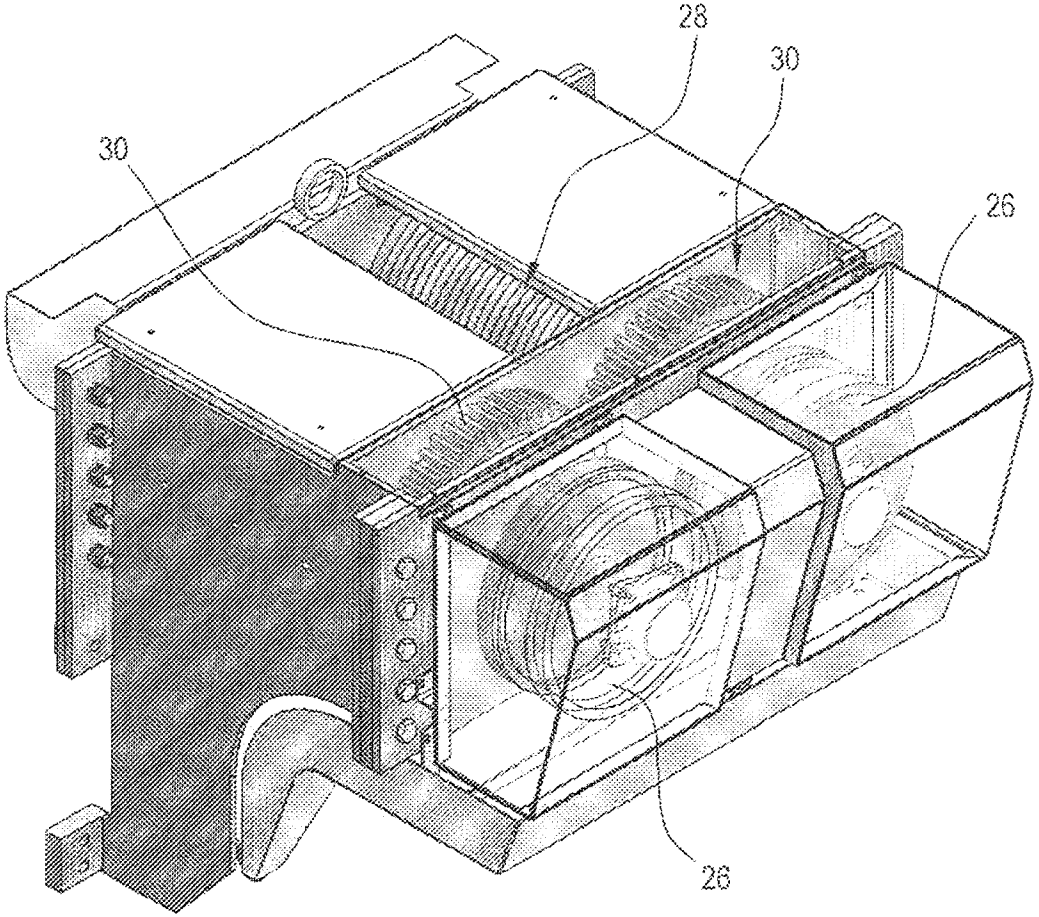
FIG. 5B is a perspective view of the winches and the respective lifting motors, with a particular illustration of the connecting means operating between them, of the preferred embodiment of the apparatus according to the present invention.

As can be observed, in particular from FIGS. 2B, 4E and 4F, said connecting means 120 between the front frame 121 and the rear frame 122 comprise corresponding connecting rod means 1230, in particular at said upper connecting means 123'.

As illustrated, the respective connecting rod 1230 has a first and second hole 1231, 1231 for receiving corresponding pivots 123'*p*, 123'*p* which insert in corresponding holes 123'*f* and 123'*f* respectively of the front frame 121 of the rear frame 122.

Said front frame 121 has corresponding plate means 12', in particular defining means for attaching the mast 20, especially so that they prolong vertically and are preferably in the form of a first and second pair of plates 12', 12' transversally spaced from one another in order to receive a respective end, in particular lower and frontally projecting 1222 of the rear frame 122 and/or for receiving a relative end of the respective connecting rod 1230, the other end of the connecting rod 1230 being preferably received between corresponding projecting front gussets 1221 of said rear frame 122, in particular at the upper end thereof.

As illustrated, said plate means 12' of said front frame 121 and said upper gussets or lower end, frontally projecting, of the rear frame 122 advantageously define or exhibit respective hole means, though in the figures only those provided on the front frame denoted with reference number 123'*a*, 123"*a* are illustrated, for the pivot means 123'*p*, 123"*p* for reciprocal connection.

A connection is obtained that is rapid and easy to predispose between the front frame and the rear frame.

As illustrated, said plate means 12' of said front frame 121 advantageously project posteriorly to said front frame 121, in particular to the transversal element and/or beam element 17 thereof.

Said plate means 12' of said front frame 121 therefore advantageously bear the connecting means 123 to the rear frame and the means for attaching of the mast 20.

The plate means 12' of said front frame 121 are preferably arranged at an intermediate zone of the transversal element and/or beam element and/or beam element 17 of the front frame 121, in particular between the end support plates of the front wheels.

Activating means 24, 24 of the traction or drive of the apparatus are advantageously provided.

Said activating means of the drive 24, 24 of the apparatus advantageously activate said front means, or wheels, for resting and movement 14, 14.

The activating means of the drive 24, 24 of the apparatus are advantageously borne by said front frame 121.

Said activating means of the drive comprise corresponding electric motor means 24, 24 in particular in the form of a first and a second electric motor, especially for activating corresponding first and second front means, or wheels 14, 14 of the apparatus.

Said electric motor means 24, 24 are advantageously borne on the internal side of the respective projecting longitudinal element 15.

As previously mentioned, the mast 20 has a first part 20' connected to the chassis 12 and a second part 20" that is extensible with respect to said first part and a possible third part of the mast 20" which is extensible with respect to the first part and the second extensible part.

Said mast 20 is advantageously able to lift the load or container to multiple heights of the standard height of the respective container, in particular up to a height corresponding to at least eight containers stacked on one another.

Activating means are advantageously provided for activating 26, 26 a lifting and a lowering of said gripping means 22 of the load, with the load 11 if present, and/or of the respective extensible part 12" of the mast 20.

Said lifting and lowering means advantageously comprise first and second activating means 26, 26.

Said activating means of lifting and lowering advantageously comprise winch means 28, 28 which raise the respective mobile element 20" of the respective extensible part of the mast 20 and/or the gripping means of the load, and the eventual load 11, in particular using continuous elongate means, in the form of respective rope means 29, 29, said winch means preferably being in the form of first and a second winches 26, 26.

Said activating means of the lifting and lowering advantageously comprise corresponding electric motor means, in particular in the form of first and second electric motors 26, 26, especially for activating corresponding first and second winches 28, 28.

Said first and second electric motor means are advantageously simultaneously or alternatively activatable, in particular in the alternatively activatable condition when there is no driving force at the other of the electric motor means, for activating the lifting and lowering of the gripping means of the load and possibly the load and/or the respective extensible part of the mast, as will clearly emerge from the following part of the description.

Operative connecting means 30, 30 are advantageously included for operative connection between said first and second activating means of the lifting and lowering in order to transmit activation there-between, in particular when driving force is lacking at one thereof.

Said operative connecting means 30, 30 are advantageously comprised between said first and second winches 28, 28 and/or the respective electric motor 26, 26 for activating the respective winch 28, 28.

Said operative connecting means are advantageously in the form of mechanical engaging means, or gears 30, 30, in particular solidly constrained to the shaft of the respective winch 28, 28, in particular arranged, as illustrated, between the respective winch 28, 28 and the respective electric motor 26, 26.

Said operative connecting means 30, 30 are advantageously in the form of engageable and disengageable means.

In particular, said operative connecting means 30, 30 are in the form of means that are engageable and disengageable when a respective electric motor 26, 26 halts.

In particular, in a different embodiment illustrated in following figures from 8A to 8C, instead of first and second winches (or drums) 28 arranged in parallel and transversally spaced from one another, as illustrated in the preceding first preferred embodiment, only one winch, or drum 128 might conceivably be used, positioned transversally with respect to the longitudinal axis of the vehicle, and sufficiently elongate for receiving the corresponding continuous elongate means, especially in the form of first and second continuous elongate means, or rope means 29, 29, and two electric motors (one per end) 26, 26 would be connected at the opposite ends of the single winch or drum 128 for activating the winch. In particular, said first and second motor connected to the ends of the single winch 128 would be simultaneously or alternatively activatable, in particular in the alternatively activatable condition when there is no driving force at the other of the electric motor means, for activating the lifting and lowering of the gripping means of the load and possibly the load and/or the respective extensible part of the mast.

Figure 8A:
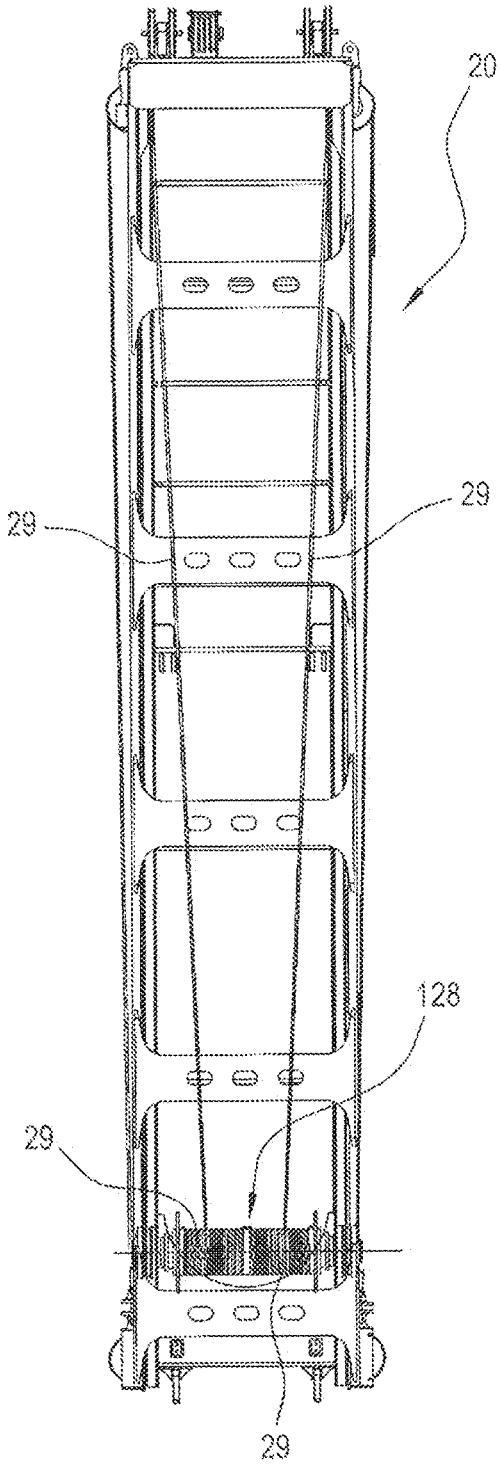
FIG. 8A is a frontal view of a further embodiment of the winch means for lifting and lowering the load and the relative gripping element and/or the corresponding extensible element of the mast, which winch means are supported by the mast of the apparatus.
Figure 8B:
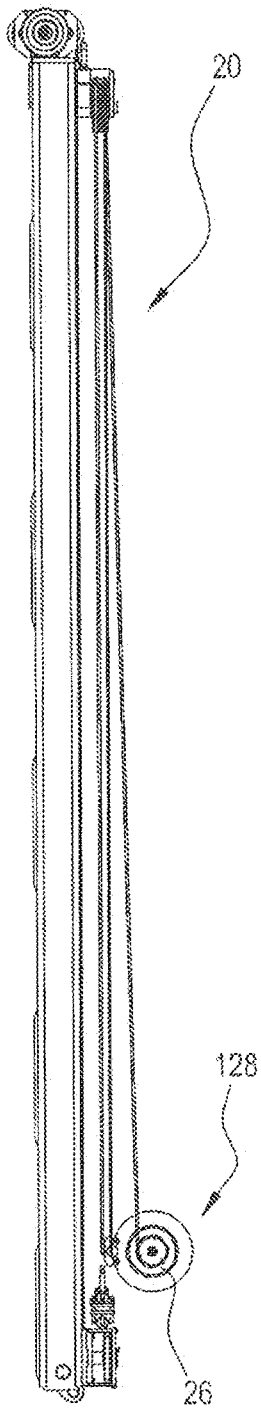
FIG. 8B is a lateral view of a further embodiment of the winch means supported by the mast of the apparatus.
Figure 8D:
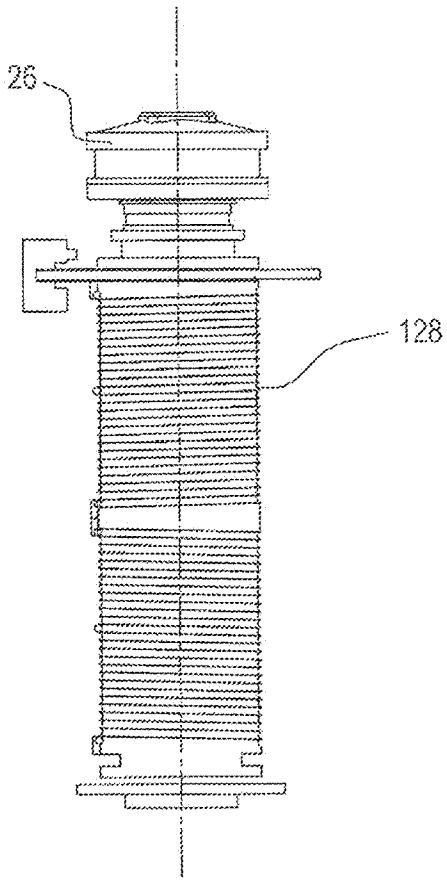
FIG. 8D is a plan view from above of the further embodiment of the winch means supported by the mast of the apparatus.
Figure 8C:
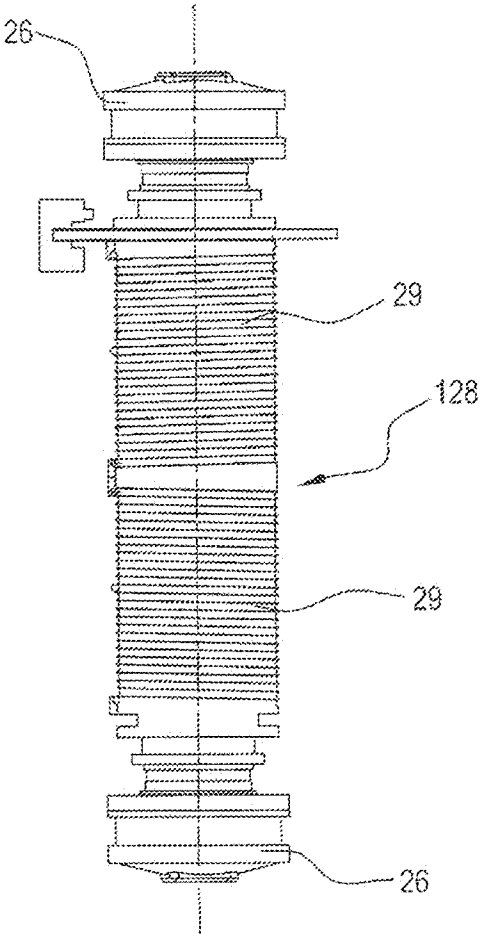
FIG. 8C is a plan view from above of the further embodiment of the winch means supported by the mast of the apparatus.

As can be observed in following FIG. 8D, it would also be conceivable to use a single electric motor 26 for activating the winch or drum 128 for respective first and second continuous elongate means, or rope means 29, 29 for lifting and lowering gripping means of the load and the possible load and/or the respective extensible part of the mast. Said activating electric motor 26 is positioned at an end of said transversal drum 128 for said first and second continuous elongate means 29, 29.

Inclination or tilting means are advantageously provided of the lifting means or mast 20, in particular in the form of respective actuator means or hydraulic cylinder means 19, 19, preferably in the form of first and second actuators or hydraulic cylinders 19, 19 interposed between the lifting means or mast 20 and the support chassis 12, in particular the rear frame 122 of the support chassis.

Figure 6A:
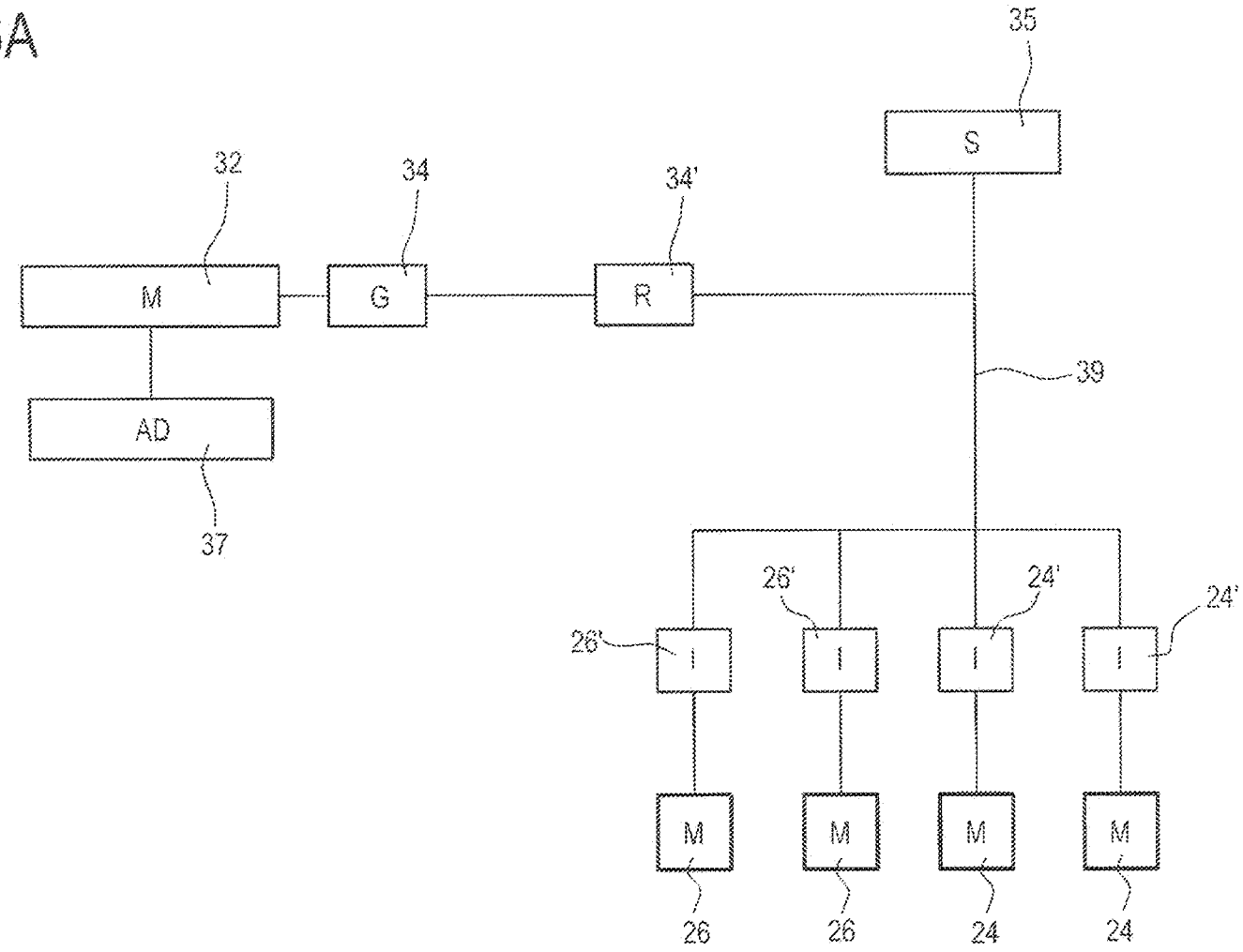
FIGS. 6A to 6F illustrate respective block diagrams and functional flow diagrams of the preferred embodiment of the apparatus according to the present invention.

As can be observed in particular in FIG. 6A, the apparatus advantageously comprises energy supply means 34, 35, in particular of electricity, to the means, or to the respective electric motor 24, 24 for activating the drive or traction of the apparatus and/or to the means, or respective electric motor 26, 26 for activating the lifting of the load.

The supply of electricity is, as illustrated, via a respective electrical circuit 39 and respective control means or inverters, in particular said control means or, denoted by numerical reference 24', 24', those controlling the activating motors of the drive or traction of the apparatus, with reference numeral 26', 26', those controlling the activating motors for lifting the load, and with reference numeral 34' those controlling the respective electricity generator 34 which will be more fully illustrated in the following part of the present description.

Said energy supply means, in particular of electricity, to the means, or to the respective electric motor 24, 24 for activating the drive or traction of the apparatus and/or to the means, or respective electric motor 26, 26 for activating the lifting of the load, advantageously comprise electricity generating means, in particular in the form of a single respective electricity generator 34.

Said energy supply means, in particular of electricity, to the means, or respective electric motor 24, 24 for activating the drive or traction of the apparatus and/or to the means, or respective electric motor 26, 26 for activating the lifting of the load, advantageously comprise electricity storage means, preferably in the form of a supercondensator or supercapacitor means, in particular constituted by a respective supercondensator or supercapacitor means 35.

The apparatus advantageously comprises primary energy supply means 32, especially comprising internal combustion engine means, supplied with a corresponding fuel housed in a respective tank of the apparatus, in particular in the form of a single internal combustion engine, preferably of the diesel type, and which activates said electricity generating means 34.

As can be observed in said FIG. 6A, the apparatus further comprises accessory means 37, in particular activated by the primary energy supply means, or internal combustion engine 32, which accessory means 37 are preferably defined by one or more of following means: the cooling fan of the internal combustion engine, the compressor of the air conditioning, the alternator, the pumping means of the oil of the hydraulic circuit, especially for the actuators or hydraulic cylinders 19 for inclining the mast.

Figure 6B:
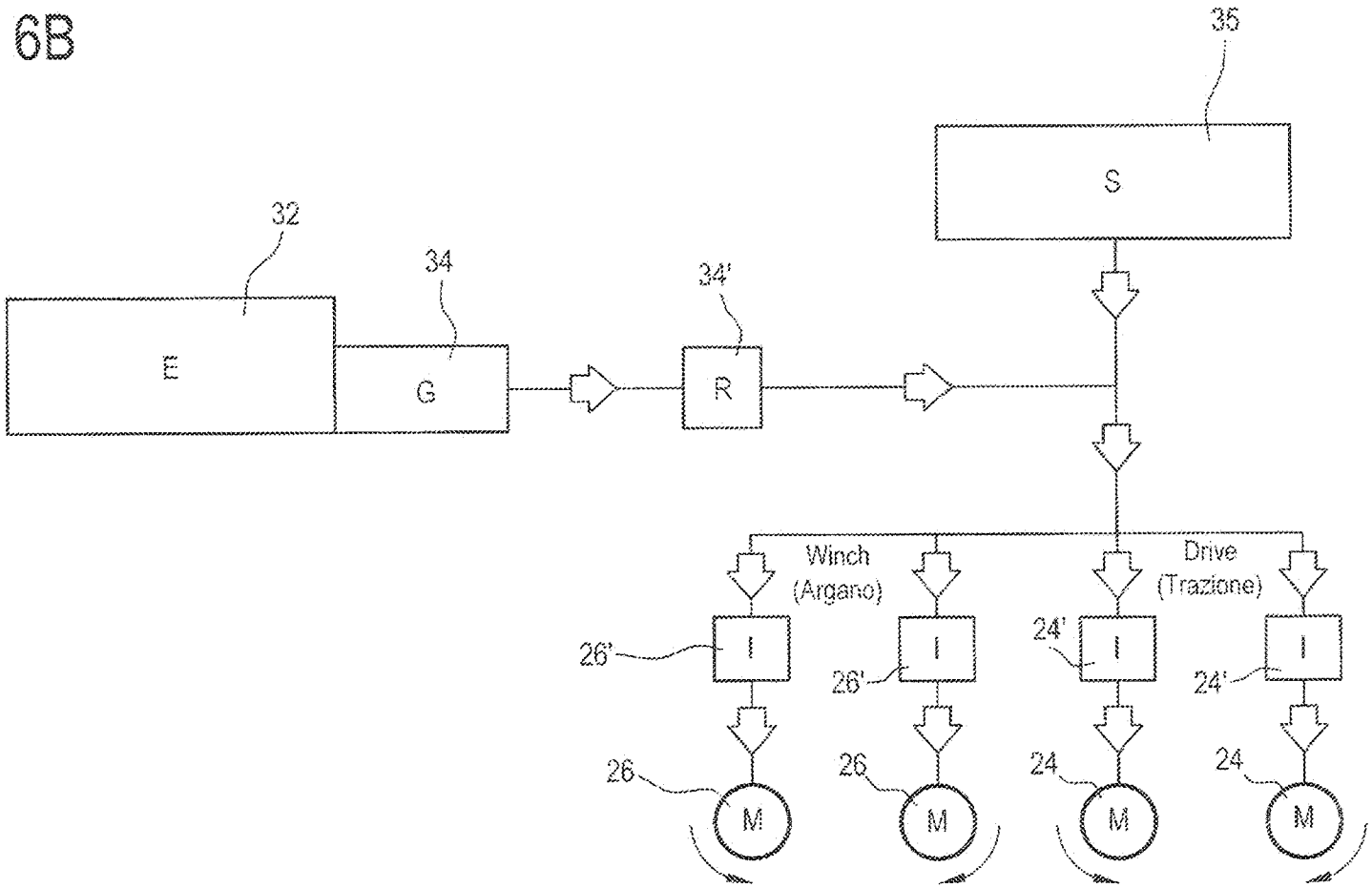

In a respective operating condition of functioning of the apparatus, in particular normal, illustrated in FIG. 6B, said electricity generating means 34 and said electricity storage means 35 are advantageously able to simultaneously supply propulsive energy to said activating means, in particular an electric motor 24, 24 of the traction or drive means of the apparatus, and/or to said activating means, in particular an electric motor 26, 26 of the lifting means of the load.

Figure 6C:
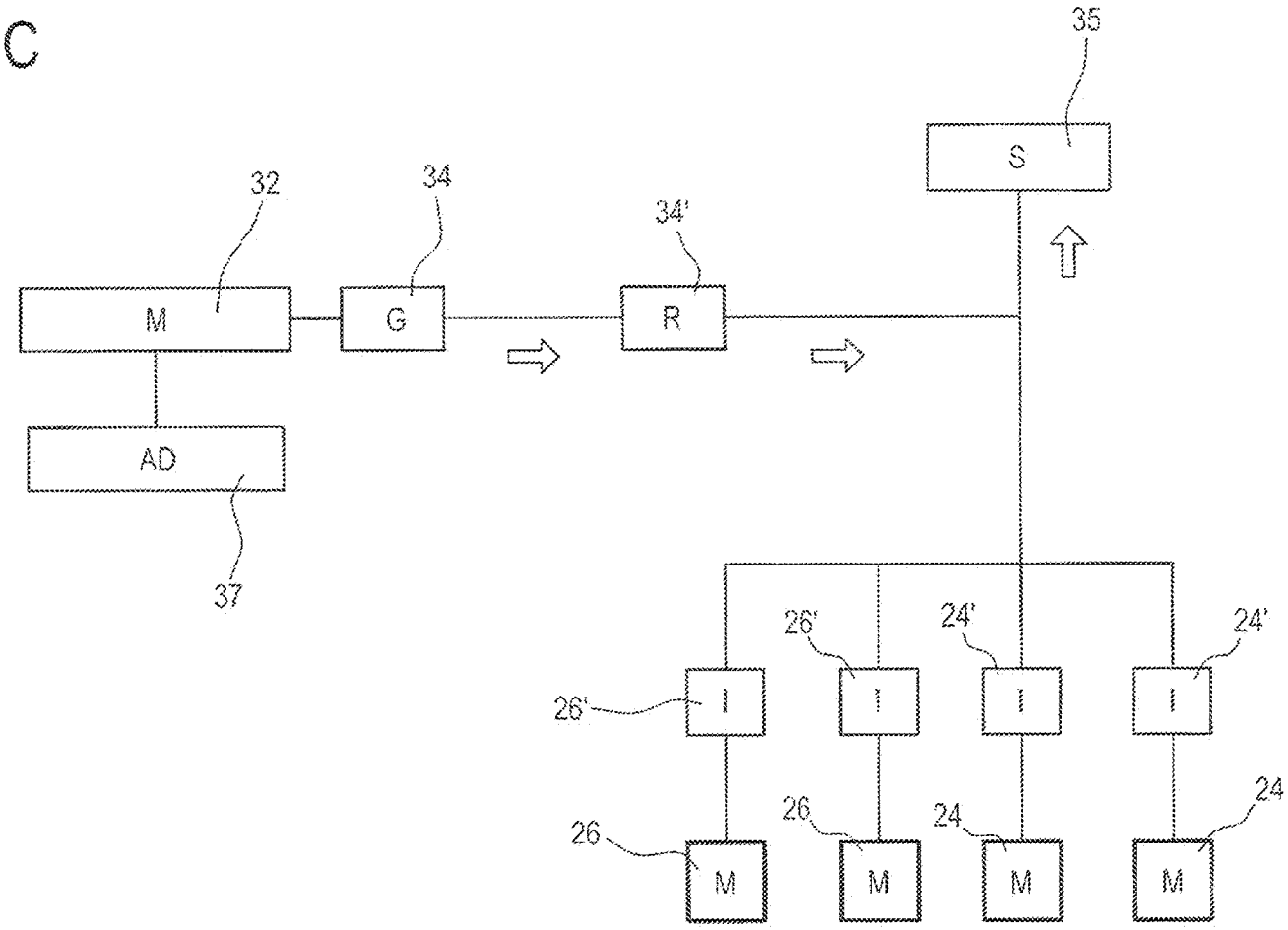

As illustrated in FIG. 6C, in a respective operating condition of functioning of the apparatus, said primary energy supply means, or internal combustion engine 32, via the respective electricity generating means, are advantageously able to supply energy to said electricity storage means 35.

Figure 6D:
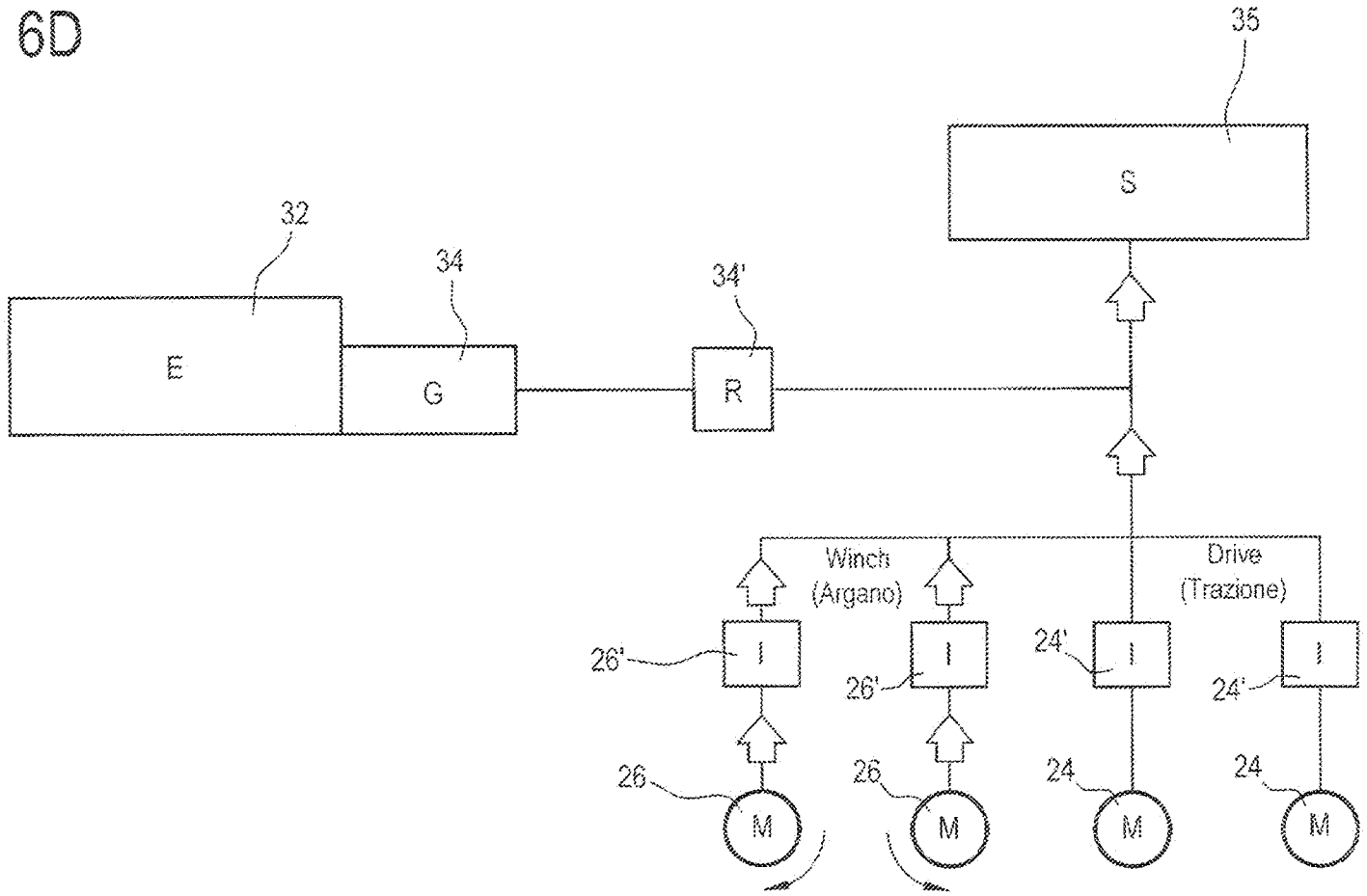

As can be seen in FIG. 6D, in a respective operating condition of functioning of the apparatus, activating means, in particular an electric motor 26, 26, of the lifting means of the load 11, on lowering the respective extensible part of the mast and/or the gripping means of the load and the load 11 if present, by exerting thereon a corresponding braking action of the lowering, are advantageously able to supply energy to said electricity storage means 35.

Figure 6E:
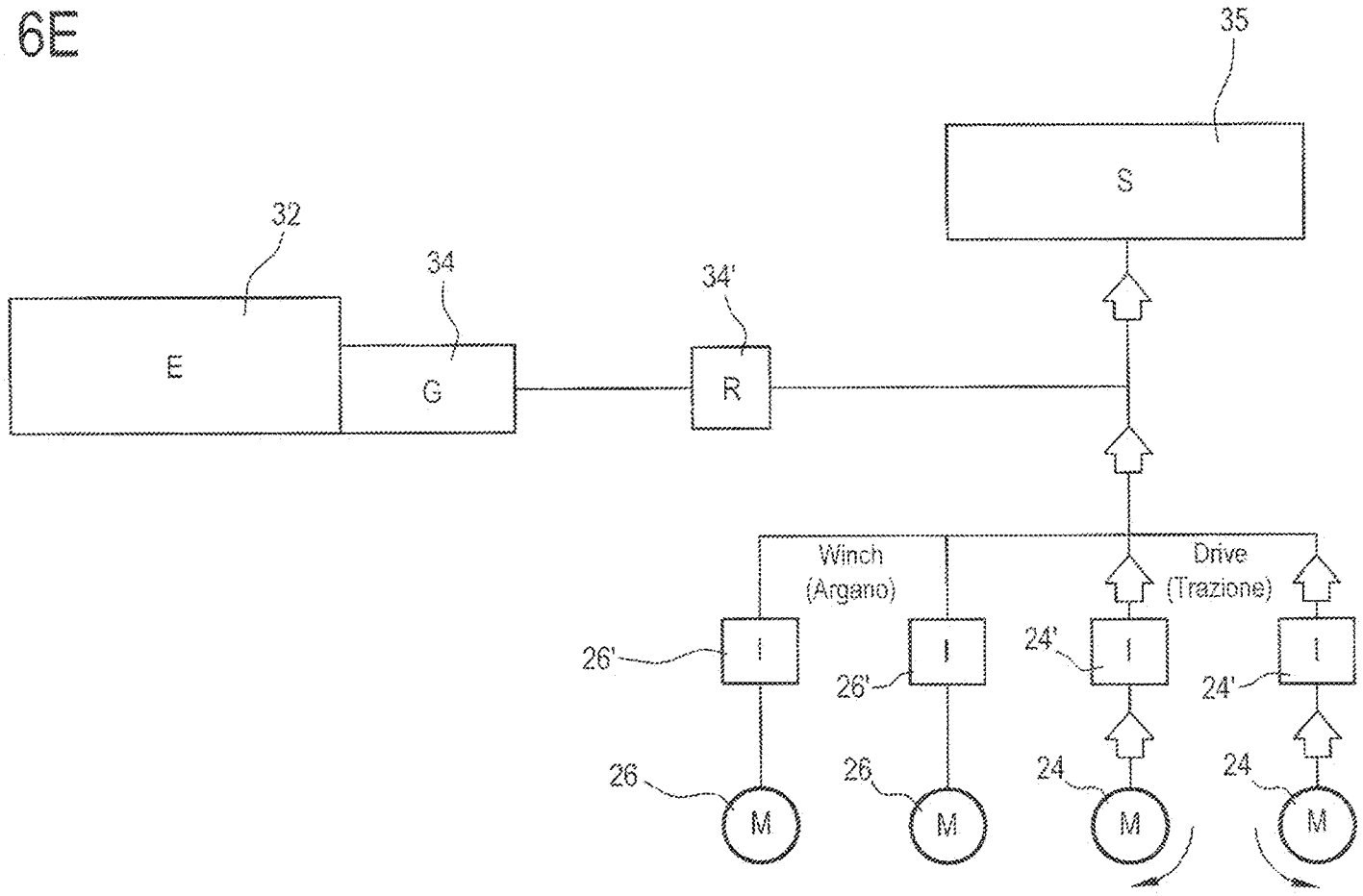

As can be seen in FIG. 6E, in a respective operating condition of functioning of the apparatus, said activating means, in particular an electric motor 24, 24 of the traction or drive means of the apparatus, by exerting a braking action of the drive of the apparatus, are able to supply energy to said electricity storage means 35.

Figure 6F:
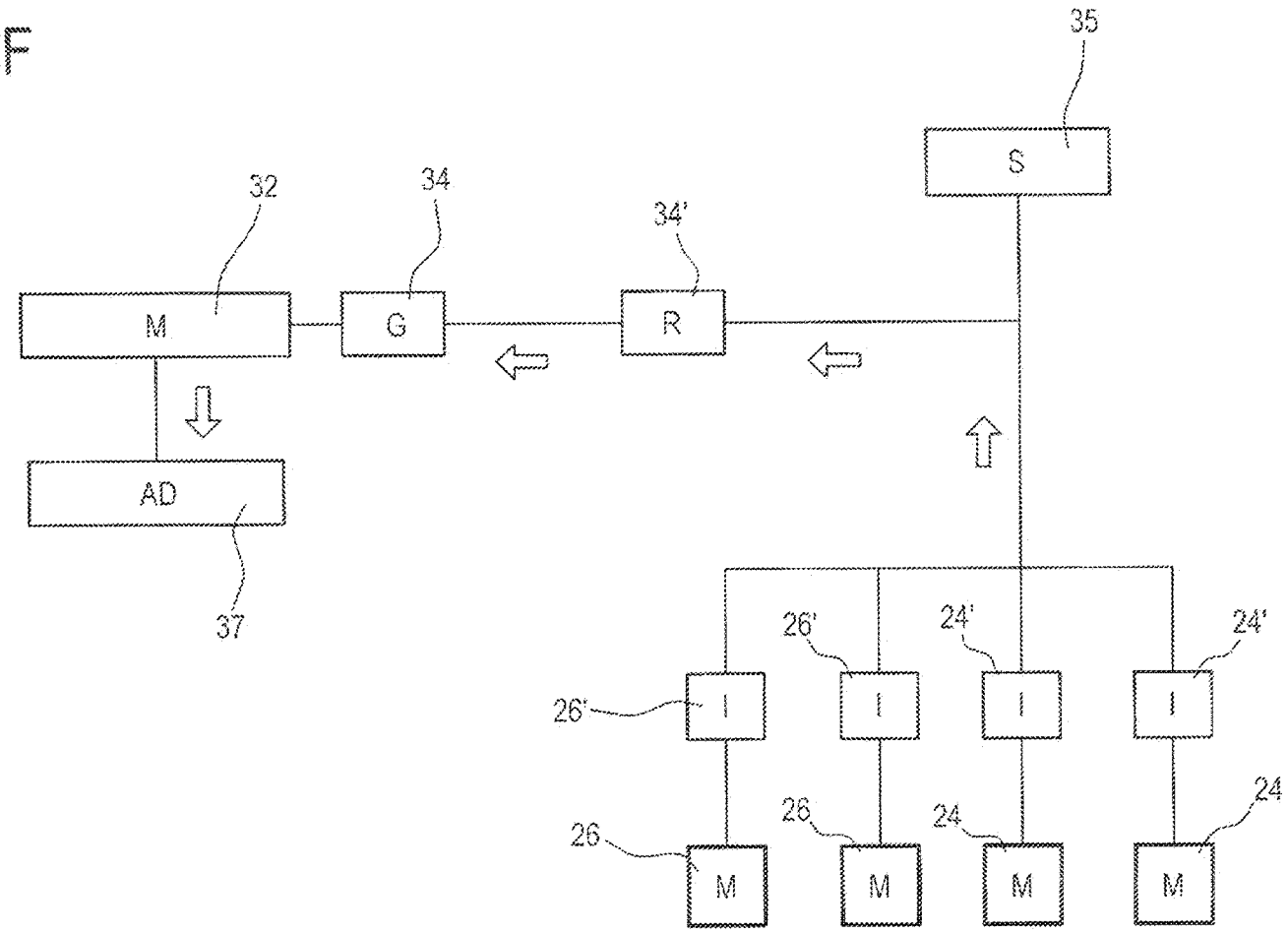

As illustrated in FIG. 6F, in a respective operating condition of functioning of the apparatus, said activating means, in particular an electric motor 24, 24 of the traction or drive means, exerting a braking action of the drive of the apparatus, and/or said activating means, in particular an electric motor 26, 26 of the lifting means on lowering the respective extensible part of the mast and/or said gripping means of the load and the load if present, exerting thereon a corresponding braking action of the lowering, are able to supply energy to said accessory means, in particular via the primary energy supply means, or internal combustion engine 32, especially when said electricity storage means, in particular a supercondensator 35, are completely charged, i.e. as a function of the charge status of the storage means 35.

Though not being specifically illustrated in the accompanying figures, the apparatus advantageously comprises control means of the energy flow between the respective energy supply means and the respective activating means of the apparatus.

Said control means of the energy flows advantageously control the charge level and/or electricity level which is stored in the storage means or supercondensator means 35 and if this is high, totally or prevalently command supply of the respective activating means by means of said energy storage means or supercondensator means 35.

Advantageously, said control means of the energy flows totally or prevalently supply the respective activating means with the energy of the storage means or supercondensator 35, as a function of the subsequent operation to be carried out, preferably as a function of the lifting height that is to be implemented by the activating means of the lifting, in particular discharging said supercondensator energy storage means 35, to such an extent that the energy storage means can subsequently store all or substantially the entire energy recyclable from the subsequent descent step of the mast and/or the gripping means of the load, and the load if present.

Said control means of the energy flows advantageously command the electricity generating means 34 to function as an electric motor for starting the internal combustion engine 35, in particular on recommencement of the drive of the apparatus and/or of the lifting of the load, preferably using the energy of said storage means or supercondensator 35.

In this latter case, the starter motor can be left unused, with a consequent lower wear and a lower risk of breakage thereof.

Obviously said control means of the energy control the flows of supply energy of the respective activating means from the energy storage means, or supercondensator means 35 and from the electricity generator 34, in particular controlling the functioning of the primary energy supply means, or internal combustion engine 32.

Said control means of the flows of energy further control the charging of the energy storage means, or supercondensator means 35 carried out by said activating means, functioning as electricity generators, of said drive means of the apparatus and/or the load lifting means, i.e. by the electricity generator 34 activated by the corresponding primary energy supply means, or internal combustion engine 32.

Figure 7:
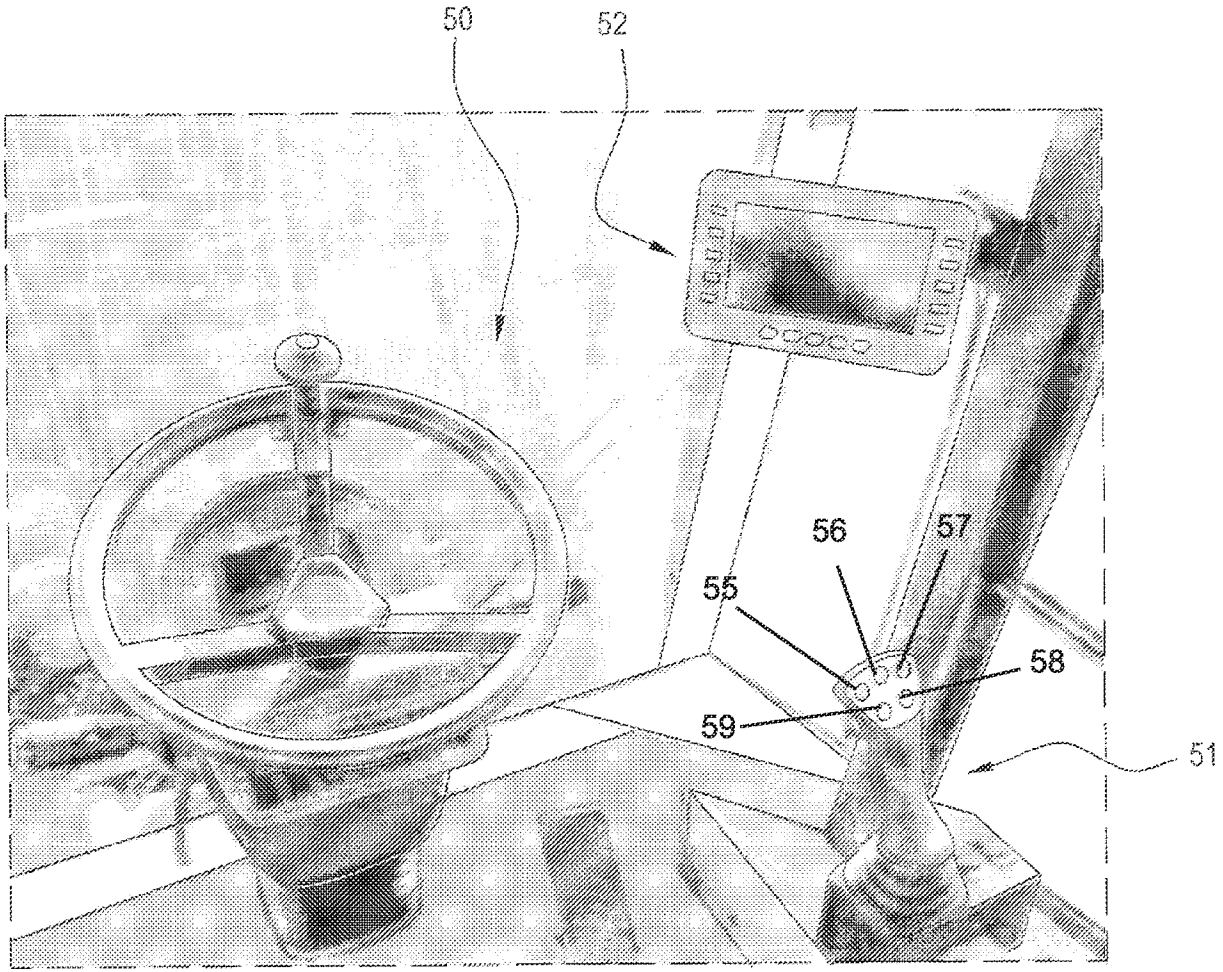
FIG. 7 is a perspective view of a detail of the driver's cab of the preferred embodiment of the apparatus according to the present invention.

As can be observed in following FIG. 7, the present apparatus advantageously comprises a station, in particular a driver's cab 50.

The apparatus advantageously comprises means 51, 52 for commanding the apparatus usable by the driver, in particular at said driver's cab 50.

Said command means of the apparatus comprise selecting means of the height of the lifting of the load, in particular in the form of a respective button.

In particular selecting means of a plurality of heights are provided, preferably in the form of a plurality of buttons 55, 56, 57, 58 and 59 (for example), each relating to a specific lifting height.

In the present apparatus, as is illustrated, said resting and movement means are in the form of wheel means, in particular comprising first and second front wheel means, composed of pairs 14, 14 of twinned wheels, and first and second rear wheel means, in particular in the form of steering wheel means 16, 16.

As can be observed in the corresponding figures, said activating means 26, 26 of the lifting and lowering of said gripping means 22 of the load, with the load 11 if present, and/or of the respective extensible part 20" of the mast 20, are supported by said mast 20, in particular by the base element 20' fixed to the support chassis 12 of the apparatus.

In this way, it is among other things advantageously possible that the tilting or rotation of the mast, with respect to the respective hinge pin to the support chassis, does not lead to the exerting of undesired stresses on the load, i.e. on the continuous elongate or transmission means 29, 29.

As can be observed in the corresponding figures, said activating means 26, 26 of the lifting and lowering of said gripping means 22 of the load, with the load 11 if present, and/or of the respective extensible part 20" of the mast 20, are advantageously fixed to the mast 20, in particular to the fixed base element 20' thereof, preferably to a transversal element that connects respective elongate longitudinal members, vertically extending, of the structure of the mast 20, i.e. the fixed base element 20' thereof.

As can be observed in the figures, said activating means 26, 26 of a lifting and a lowering of said gripping means 22 of the load, with the load 11 if present, and/or of the respective extensible part 20" of the mast 20 are advantageously arranged posteriorly of the mast, in particular posteriorly to the fixed base element 20' thereof, i.e. on the side of the mast 20 which is opposite with respect to the gripping side of the load 11.

As can be observed in the figures, said activating means 26, 26 of a lifting and a lowering of said gripping means 22 of the load, with the load 11 if present, and/or of the respective extensible part 20" of the mast 20 are advantageously arranged at the lower part of the mast, in particular posteriorly to the fixed base element 20' thereof.

As can be observed in the corresponding figures, said activating means 26, 26 of a lifting and a lowering of said gripping means 22 of the load, with the load 11 if present, and/or of the respective extensible part 20" of the mast 20, extend projectingly from said mast 20, in particular from the fixed base element 20' thereof.

In the preferred embodiment illustrated in FIGS. 1 to 7, said activating means 26, 26 of the lifting and lowering of said gripping means 22 of the load, i.e. the respective winch 128 and/or the respective electric motor 26, 26 for activating the respective winch 128, advantageously have the respective rotation axis which is directed longitudinally, i.e. parallel to the longitudinal extension direction of the support chassis 12 of the apparatus.

In the preferred embodiment illustrated in FIGS. 8A to 8D, said activating means 26, 26 of the lifting and lowering of said gripping means 22 of the load, i.e. the respective winch 28 and/or the respective electric motor 26, 26 for activating the respective winch 28, 28 advantageously have the respective rotation axis which is directed parallel to the mast 20, i.e. transversally to the longitudinal extension direction of the support chassis 12 of the apparatus.

As can be observed in the corresponding figures, said activating means 26, 26 of a lifting and a lowering of said gripping means 22 of the load, with the load 11 if present, and/or of the respective extensible part 20" of the mast 20, i.e. the respective winch means 28, 28 and relative activating motor means, are housed internally of a corresponding protective covering, which surrounds and encloses, preferably completely, said activating means, and which is preferably supported by the support and fixing means of the activating means 26, 26 to said mast 20.

The invention described has evident industrial applications. It would be obvious to one skilled in the art that several changes and/or modifications can be made to the invention without departing from the spirit and scope of the invention, described in depth above. Also, further preferred embodiments of the invention comprising one or more of the features described herein can easily be conceived. Moreover, it will be understood that all the details of the invention may be substituted by technically equivalent elements.

The invention claimed is:

1. An apparatus for lifting and transporting a load, comprising:

a support chassis;

a front movement mechanism attached to the support chassis for supporting and moving the support chassis, the front movement mechanism including a front wheel, rotatable with respect to a ground surface, for moving the support chassis;

a rear movement mechanism attached to the support chassis for supporting and moving the support chassis, the rear movement mechanism including a rear wheel, rotatable with respect to the ground surface, for moving the support chassis;

at least one chosen from the front rotatable member and the rear rotatable member including a rotation axis that is at least one chosen from transversal to a front-rear axis of the apparatus and horizontal;

a lifting and lowering mechanism for lifting and lowering the load, comprising:

a mast extending upwards, the mast including a first part attached to the support chassis and a second part telescopically extensive with respect to the first part;

a gripping mechanism for gripping the load, the gripping mechanism attached to the mast to be movable along the mast;

an activating mechanism for lifting and lowering at least one chosen from the gripping mechanism and the second part of the mast, the activating mechanism including an electric motor;

an electrical energy supply for supplying electrical energy to the electric motor, the electrical energy supply including an electrical generator and an electricity storage system;

wherein, upon lowering of the at least one chosen from the gripping mechanism and the second part of the mast, the electric motor provides a braking action to the at least one chosen from the gripping mechanism and the second part of the mast while also supplying electrical energy to the electricity storage system; and wherein, in an operating condition of the apparatus, the electricity generator and the electricity storage system simutaneously supply propulsive energy to the activating mechanism.

2. The apparatus according to claim 1, wherein the mast is configured to lift the load to multiples of a standard height of a container.

3. The apparatus according to claim 1, wherein the activating mechanism incldues first and second activating mechanisms.

4. The apparatus according to claim 1, wherein the activating mechanism includes a winch configured to raise at least one chosen from the second part and the gripping mechanism.

5. The apparatus according to claim 1, wherein the electrical energy supply supplies energy to the electric motor for activating a drive of the apparatus.

6. The apparatus according to claim 1, wherein the electricity storage system includes at least one chosen from a superoondensator and a supercapacitor.

7. The apparatus according to claim 6, wherein in a respective operating condition of the apparatus, the electric motor exerts a braking action on a drive of the apparatus, to supply electrical energy to the electricity storage system.

8. The apparatus according to claim 1, and further comprising an internal combustion engine for driving the electricity generator.

9. The apparatus according to claim 8, wherein in a respective operating condition of the apparatus, the internal combustion engine, via the electricity generator, supplies electrical energy to the electricity storage system.

10. The apparatus according to claim 1, and further comprising a controller for controlling electrical energy flow between the electrical energy supply and the activating mechanism.

11. The apparatus according to claim 10, wherein the controller is configured to control at least one chosen from a charge level and an electricity level stored in the electricity storage system and if the at least one chosen from the charge level and the electricity level is high, at least predominantly commanding electrical engery supply of the activating mechanism via the electricity storage system.

12. The apparatus according to claim 10, wherein the controller is configured to provide electrical energy supply to the activating mechanism as a function of a lifting height to be implmented by the activating mechanism, by discharging the electricity storage system such that the electricity storage system will subsequently store a predominant amount of electrical enemy recyclable from a subsequent lowering of the at least one chosen from the gripping mechanism and the second part of the mast.

13. The apparatus according to claim 10, wherein the controller is configured to command the electricity generator to function as an electric motor to start an internal combustion engine of the apparatus upon at least one chosen from commencement of a drive of the apparatus and lifting of the load, using the electrical energy of the electricity storage.

14. The apparatus according to claim 10, wherein the controller is configured to control the electrical energy supply between the activating mechanism and the electrical energy supply by controlling at least one chosen from the electricity generatore driven by an internal combustion engine of the apparatus and charging of the electricity storage system by the activating mechanism generating electrical energy.

15. The apparatus according to claim 1, and further comprising a driver's cab.

16. The apparatus according to claim 15, and further comprising user controls at the driver's cab for controlling the apparatus by a driver.

17. The apparatus according to claim 16, wherein the user controls include a height selection device for selecting a height of lifting of the load, the height selection device including a plurality of buttons, each of which selects a respective lifting height.

18. An apparatus for lifting and transporting a load, comprising:

a support chassis;

a front movement mechanism attached to the support chassis for supporting and moving the support chassis, the front movement mechanism including a front wheel, rotatable with respect to a ground surface, for moving the support chassis;

a rear movement mechanism attached to the support chassis for supporting and moving the support chassis, the rear movement mechanism including a rear wheel, rotatable with respect to the ground surface, for moving the support chassis;

at least one chosen from the front rotatable member and the rear rotatable member including a rotation axis that is at least one chosen from transversal to a front- rear axis of the apparatus and horizontal;

a lifting and lowering mechanism for lifting and lowering the load, comprising:

a mast extending upwards, the mast including a first part attached to the support chassis and a second part telescopically extensible with respect to the first part;

a gripping mechanism for gripping the load, the gripping mechanism attached to the mast to be movable along the mast;

an activating mechanism for lifting and lowering at least one chosen from the gripping mechanism and the second part of the mast, the activating mechanism including an electric motor;

an electrical energy supply for supplying electrical energy to the electric motor, the electrical energy supply including an electricity generator and an electricity storage system;

wherein, upon lowering of the at least one chosen from the gripping mechanism and the second part of the mast, the electric motor provides a braking action to the at least one chosen from the gripping mechanism and the second part of the mast while also supplying electrical energy to the electricity storage system;

a controller for controlling electrical energy flow between the electrical energy supply and the activating mechanism; and wherein the controller is configured to control at least one chosen from a charge level and an electricity level stored in the electricity storage system and if the at least one chosen from the charge level and the electricity level is high, at least predominantly commanding electrical energy supply of the activating mechanism via the electricity storage system.

19. An apparatus for lifting and transporting a load, comprising:

a support chassis;

a front movement mechanism attached to the support chassisfor supporting and moving the support chassis, the front movement mechanism including a front wheel, rotatable with respect to a ground surface, for moving the support chassis;

a rear movement mechanism attached to the support chassis for supporting and moving the support chassis, the rear movement mechanism including a rear wheel, rotatable with respect to the ground surface, for moving the support chassis;

at least one chosen from the front rotatable member and the rear rotatable member including a rotation axis that is at least one chosen from transversal to a front-rear axis of the apparatus and horizontal;

a lifting and lowering mechanism for lifting and loweringthe load, comprising:

a mast extending upwards, the mast including a first part attached to the support chassis and a second part telescopically extensible with respect to the first part;

a gripping mechanism for gripping the load, the gripping mechanism attached to the mast to be movable along the mast;

an activating mechanism for lifting and lowering at least one chosen from the gripping mechanism and the second part of the mast, the activating mechanism including an electric motor;

an electrical energy supply for supplying electrical energy to the electric motor, the electrical energy supply including an electricitygenerator and an electricitystorage system;

wherein, upon lowering of the at least one chosen from the gripping mechanism and the second part of the mast, the electric motor provides a braking action to the at least one chosen from the gripping mechanism and the second part of the mast while also supplying electrical energyto the electricity storage system;

a controller for controlling electrical energy flow between the electrical energy supply and the activating mechanism; and user controls for controllingthe apparatus by a driver, wherein the user controls include a height selection device for selecting a lifting height of the load, the height selection device including a plurality of buttons, each of which selects a respective lifting height;

wherein the controller is configured to provide electrical energy supply to the activating mechanism as a function of the lifting height to be implemented bythe height selection device, by discharging the electricity storage system such that the electricity storage system will subsequently store a predominant amount of electrical energy recyclable from a subsequent lowering of the at least one chosen from the gripping mechanism and the second part of the mast.

20. An apparatus for lifting and transporting a load, comprising:

a support chassis;

a front movement mechanism attached to the support chassis for supporting and moving the support chassis, the front movement mechanism including a front wheel, rotatable with respect to a ground surface, for moving the support chassis;

a rear movement mechanism attached to the support chassis for supporting and moving the support chassis, the rear movement mechanism including a rear wheel, rotatable with respect to the ground surface, for moving the support chassis;

at least one chosen from the front rotatable member and the rear rotatable member including a rotation axis that is at least one chosen from transversal to a front-rear axis of the apparatus and horizontal;

a lifting and lowering mechanism for lifting and lowering the load, comprising:

a mast extending upwards, the mast including a first part attached to the support chassis and a second part telescopically extensible with respect to the first part;

a gripping mechanism for gripping the load, the gripping mechanism attached to the mast to be movable along the mast;

an activating mechanism for lifting and lowering at least one chosen from the gripping mechanism and the second part of the mast, the activating mechanism including an electric motor;

an electrical energy supply for supplying electrical energy to the electric motor, the electrical energy supply including an electricity generator and an electricity storage system;

wherein, upon lowering of the at least one chosen from the gripping mechanism and the second part of the mast, the electric motor provides a braking action to the at least one chosen from the gripping mechanism and the second part of the mast while also supplying electrical energy to the electricity storage system;

a controller for controlling electrical energy flow between the electrical energy supply and the activating mechanism; and wherein the controller is configured to command the electricity generator to function as an electric motor to start an internal combustion engine of the apparatus upon at least one chosen from commencement of a drive of the apparatus and lifting of the load, using the electrical energy of the electricity storage system.

* * * * *